US006008828A

United States Patent [19]

Furuki et al.

[11] Patent Number: 6,008,828

[45] Date of Patent: Dec. 28, 1999

[54] IMAGE FORMING APPARATUS INCLUDING CONDUCTING POLYMER LAYER FOR IONIC DYE INTAKE AND RELEASE

[75] Inventors: Makoto Furuki; Shigemi Ohtsu; Lyong Pu, all of Ashigarakami-gun, Japan

[73] Assignee: Fuji Xerox Co., Ltd., Tokyo, Japan

[21] Appl. No.: 08/742,832

[22] Filed: Oct. 31, 1996

[30] Foreign Application Priority Data

Nov. 6, 1995 [JP] Japan ..... 7-287491

[51] Int. Cl.[6] ..... B42J 2/385; G03G 13/04

[52] U.S. Cl. ..... 347/139; 347/153; 428/157

[58] Field of Search ..... 428/457, 461, 428/462, 195, 522; 252/500, 510, 586, 183.11; 257/40; 359/266, 893; 430/900; 205/50, 317; 347/139, 153, 111

[56] References Cited

U.S. PATENT DOCUMENTS

| | | | |
|---|---|---|---|
| 4,172,180 | 10/1979 | Takeda et al. | 428/522 |
| 4,571,029 | 2/1986 | Skotheim et al. | 350/357 |
| 4,749,260 | 6/1988 | Yang et al. | 350/357 |
| 5,063,128 | 11/1991 | Yun et al. | 430/63 |
| 5,253,100 | 10/1993 | Yang et al. | 359/266 |
| 5,324,453 | 6/1994 | Cao et al. | 252/500 |
| 5,357,357 | 10/1994 | Imazeki et al. | 359/76 |
| 5,520,852 | 5/1996 | Ikkala et al. | 252/521 |
| 5,540,862 | 7/1996 | Cao et al. | 252/500 |
| 5,568,417 | 10/1996 | Furuki et al. | 365/106 |
| 5,677,546 | 10/1997 | Yu | 257/40 |
| 5,762,772 | 6/1998 | Tomono | 204/478 |
| 5,773,130 | 6/1998 | So et al. | 428/195 |
| 5,863,651 | 1/1999 | Harris et al. | 428/357 |
| 5,892,529 | 4/1999 | Tatsuura et al. | 347/139 |

FOREIGN PATENT DOCUMENTS

| | | |
|---|---|---|
| 0 017 717 | 10/1980 | European Pat. Off. . |
| 0 044 695 | 1/1982 | European Pat. Off. . |
| 29 05 976 | 8/1979 | Germany . |
| 50-14342 | 2/1975 | Japan . |
| 50-21741 | 3/1975 | Japan . |
| 50-21742 | 3/1975 | Japan . |
| 52-16233 | 2/1977 | Japan . |
| 61-066693 | 4/1986 | Japan . |
| 2-142835 | 5/1990 | Japan . |
| 2-292084 | 12/1990 | Japan . |

OTHER PUBLICATIONS

"Polymer Preprints," Japan vol. 32, No. 7 (1983), pp. 1723–1726 (no month).

Takeo Shimidzu, Functionalized Conducting Polymer for Development of New Polymeric Reagents, Reactive Polymers, 6 1987 pp. 221–227 (no month).

Hiroaki Shinohara et al., "Ion–sieving of Electrosynthesized Polyprrole Films," J. Chem. Soc., Chem. Commun., 1986 pp. 87–88 (no month).

Shinohara et al., *Journal of the Society of Chemistry of Japan*, No. 3, p. 465, 1986 (no month).

*Primary Examiner*—John J. Zimmerman
*Assistant Examiner*—Michael LaVilla
*Attorney, Agent, or Firm*—Oliff & Berridge, PLC

[57] ABSTRACT

A conducting polymer thin film which comprises a conducting polymer capable of undergoing a physicochemical state change between at least two of an oxidized state, a neutral state, and a reduced state, said conducting polymer in at least one of these states retaining ionic dye molecules incorporated among the molecules thereof. The conducting polymer thin film of the present invention is reduced in power consumption, does not generate any harmful substance, and is capable of being used for continuous image formation. The process for producing the conducting polymer thin film, a method of working the conducting polymer thin film, a method of image formation with the conducting polymer thin film, and an apparatus for image formation are also disclosed.

7 Claims, 16 Drawing Sheets

IMAGE FORMING APPARATUS INCLUDING CONDUCTING POLYMER LAYER FOR IONIC DYE INTAKE AND RELEASE

FIELD OF THE INVENTION

The present invention relates to a conducting polymer thin film, a process for producing the same, a method of working the conducting polymer thin film, a method of image formation, and an apparatus for image formation. More particularly, this invention relates to a conducting polymer thin film in which ionic dye molecules can be incorporated and kept, a process for producing the same, a method of working the conducting polymer thin film for controlling the behavior of ionic dye molecules in the conducting polymer thin film, and a method and an apparatus for image formation by means of ionic dye molecules.

BACKGROUND OF THE INVENTION

Techniques currently utilized in printers and the like for transferring an image to a recording medium, e.g., paper, based on electrical or optical signals include dot-impact printing, thermal transfer printing, thermal sublimation printing, ink-jet printing, and electrophotography in laser printers. These techniques are roughly classified into three groups.

One group includes dot-impact printing, thermal transfer printing, and thermal sublimation printing. In these techniques, a sheet containing dye molecules dispersed therein, e.g., an inked ribbon or a donor film, is superposed on paper or the like, and the dye is transferred to the paper by means of mechanical impacts or heating. These techniques therefore have drawbacks that expendables are always necessary, that it is difficult to increase the printing speed, and that the printing has a low energy efficiency and high running cost. Moreover, the prints obtained with these techniques excluding thermal sublimation printing have poor quality.

On the other hand, ink-jet recording, which is included in another group, has an advantage that running cost is low because an ink is directly transferred from heads to paper and expendables other than an ink are hence unnecessary. However, it is difficult to increase the speed of ink-jet printing, because all dots are formed with electrical control and because of difficulty in fabricating an array of heads having the width of the paper. Another drawback of ink-jet printing is that since the minimum image unit is determined by head size and head interval, higher print quality results in lower printing speeds and lower energy efficiencies.

Electrophotography, which is included in the remaining group and is used in laser printers, etc., is a technique of forming an image through an intermediate transfer medium. In electrophotography, a toner is adsorbed onto an electrostatic image formed on a photoreceptor by laser spots, and the adsorbed toner is transferred to paper to form an image. Electrophotography can hence form relatively fine images. In addition, it has an advantage of low running cost because a toner is the only expendable. However, electrophotography has problems that the consumption of electrical power is large because of the necessity of a high voltage for the formation of latent images and for the adsorption and transfer of a toner, and that electrophotographic apparatuses generate ozone and nitrogen oxides. All the printing techniques described above further have a problem of a considerably loud printing noise.

On the other hand, among the image-forming techniques which give high-quality images are conventional printing techniques using a printing plate and silver halide photography. However, the conventional printing techniques have a drawback that these are unsuitable for general applications because of the necessity of forming a plate, although the running cost thereof is low when the same image is formed in a large quantity. Silver halide photography and the like have drawbacks that because of the necessity of using media which are not reusable, such as photographic films and photographic printing paper, the running cost thereof is high and an increase in printing speed is not expected.

As described above, any of the image-forming techniques currently utilized in printers and the like is not a printing technique which gives high-quality images, attains a relatively high printing speed and a low running cost, is energy-saving and resource-saving, and is environmentally friendly and user friendly.

One means for eliminating the above-described problems may be to utilize a medium with which an image distribution corresponding to the image to be printed is formed with an image-forming element, e.g., a toner or an ink, on the same scale (the same paper width) as on the receiving material and is transferred indirectly or directly. This medium, which functions as a temporary holder for an image-forming element, is required not only to attain a relatively small energy consumption and continuous tone in the incorporation and release (transfer) of the image-forming element but also to be capable of coping with size reduction in units of the image-forming element.

Examples of media which can satisfy such requirements include films of conducting polymers represented by polypyrrole, polythiophene, and polyaniline. It is known that films of these polymers can be chemically, electrically, or electrochemically regulated so as to come into any of three states, i.e., oxidized, neutral, and reduced states, and these state changes are accompanied by doping with and undoping of counter ions. Such properties are described in detail in, e.g., Susumu Yoshimura, "Dō densei Porimā (Conducting Polymer)" (The Society of Polymer Science, Japan); Kazuo Yamashita and Hiroshi Kitani, "Dō densei Yū ki Hakumaku No Kinō To Sekkei (Function and Design of Electroconductive Organic Thin Film)" (The Society of Surface Science, Japan); and Katsumi Yoshino "Dōdensei Kōbunshi No Kiso To Ōyō (Fundamental and Application of Conducting polymer)" (IPC).

To sum up, a conducting polymer thin film capable of being doped with dye molecule ions and undoped to release the ions is expected to function as a temporary image-forming-element holder which satisfies the requirements described above. However, the counter ions with which conducting polymers are doped and undoped have generally been limited to the anions and cations of general metals and small molecule electrolytes. It is known that in the case where a conducting polymer is synthesized in the presence of, e.g., high molecular anions or the like, the resulting polymer cannot be undoped.

On the other hand, the size of ions with which a conducting polymer film can be reversibly doped and undoped is determined by the microstructure of the film. It has been reported in Hiroaki Shinohara et al., J. *Chem. Soc., Chem.* Commun., p. 87 (1986) that the size of those ions can be controlled, for example, by regulating the size of counter ions in the presence of which a monomer is polymerized to produce the conducting polymer. However, the molecular weights of the ions investigated in the above report are up to about 100, and the results given therein show that the higher the molecular weight, the poorer the doping/undoping characteristics. Although an example of reversible doping/undoping with relatively large molecules has been reported by the same investigators including Shinohara in *Journal of Chemical Society of Japan*, No. 3, p. 465 (1986), this investigation was made with glutamic acid, whose molecular weight is below 150. On the other hand, many generally employed dyes have a molecular weight in the range of about from 500 to 1,500; it has hitherto been thought that conducting polymer films cannot be reversibly doped with and undoped of ions having such a high molecular weight.

Prior art applications of conducting polymer films based on such doping/undoping with low-molecular weight ions and on the accompanying color changes have been directed mainly to protective films for batteries and solar cells and to electrochromic display elements. On the other hand, use of a conducting polymer film as a material for marking is disclosed in JP-A-2-142835, "Method for Controlling Wettability of Surface of Thin Polymer Film and Method and Material for Image Formation Based on that Method." (The term "JP-A" as used herein means an "unexamined published Japanese patent application.") However, this prior art technique has a drawback that since a printing plate is formed by changing the wettability of a conducting polymer film by means of electrical shifting between an oxidized state and a neutral state, the conducting polymer thin film neither functions to keep a dye therein through doping, nor is regulated at all with respect to the adsorption or transfer amount of a dye, e.g., an ink.

SUMMARY OF THE INVENTION

A first object of the present invention is to provide a conducting polymer thin film for use in a method of image formation which has the features described hereinabove, that is, which gives high-quality images, attains a relatively high printing speed and low running cost, is energy-saving and resource-saving, and is environmentally friendly and user friendly, and to provide a process for producing the film.

A second object of the present invention is to provide a film-working method suitable for use in a method of image formation having the above-described features.

A third object of the present invention is to provide a method of image formation having the above-described features.

A fourth object of the present invention is to provide an apparatus for image formation having the features described above.

The present invention has been achieved as a result of investigations on the behavior of ionic dye molecules in conducting polymer thin films.

The first object of the present invention described above is accomplished with a conducting polymer thin film which comprises a conducting polymer capable of undergoing a physicochemical state change between at least two of an oxidized state, a neutral state, and a reduced state, said conducting polymer in at least one of these states retaining dye molecules incorporated among the molecules thereof; and with a process for producing the conducting polymer thin film which comprises polymerizing at least one monomer for a conducting polymer in the presence of ions having a high molecular weight to thereby form the conducting polymer thin film.

The conducting polymer thin film retaining ionic dye molecules incorporated therein is capable of releasing the ionic dye molecules upon a state change caused by an electrochemical operation, and these ionic dye molecules can be used as an image-forming element.

The second object of the present invention described above is accomplished with a method of working a conducting polymer thin film capable of undergoing a physicochemical state change between at least two of an oxidized state, a neutral state, and a reduced state, said method comprising causing the film to undergo the state change to thereby incorporate and keep ionic dye molecules in the film or release the ionic dye molecules from the film.

Upon oxidation, neutralization, and reduction, the conducting polymer thin film is doped with ions and undoped. This state change takes place when the conducting polymer thin film receives and gives charges, regardless of methods for charge exchanges and of substances with which charges are exchanged. The simplest method for electrochemically causing a state change is to form a conducting polymer thin film on an electrode substrate to conduct charge exchanges between the film and the electrode.

By working such a conducting polymer thin film in such a manner that ionic dye molecules can be incorporated and kept therein and released therefrom, the conducting polymer thin film can be applicable to image formation.

The third object of the present invention described above is accomplished with a method of image formation which comprises regulating a conducting polymer thin film formed on an electrode substrate so as to come into an oxidized state or a reduced state according to a desired image to thereby form a dye density distribution in the conducting polymer thin film according to the desired image based on the amount of an ionic dye incorporated in or released from the film, and transferring the dye to a recording medium to form the image.

In the above method, the conducting polymer thin film formed on an electrode substrate is regulated so as to come into an oxidized state or a reduced state according to the desired image to thereby incorporate an ionic dye according to the desired image. Alternatively, the conducting polymer thin film formed on an electrode substrate is regulated so as to come into an oxidized state or a reduced state according to the desired image to thereby release the ionic dye from the film according to the desired image. Thus, a dye density distribution is formed based on the incorporation amount or release amount of ionic dye molecules. The ionic dye molecules are then transferred to a recording medium to form an image.

As described above, the method of image formation may be carried out in two ways: (1) a mode in which a density distribution is formed in the incorporation amount of ionic dye molecules; and (2) a mode in which a density distribution is formed in the release amount of ionic dye molecules, while keeping the incorporation amount of ionic dye molecules constant. In these modes, dye replenishment is conducted only in the amount corresponding to the ionic dye molecules necessary for image formation, i.e., the released ionic dye molecules. Namely, the rate of the consumption of ionic dye molecules is low. Other advantages of the above method are that the size of image units can be reduced to the molecular level, and that marking can be conducted with continuous tone.

The fourth object of the present invention described above is accomplished with an apparatus for image formation which comprises a conducting polymer thin film formed on an electrode, a incorporation and release means for incorporating ionic dye molecules into the conducting polymer thin film and for releasing the dye molecules from the film, and a transfer means for transferring the ionic dye molecules released by the incorporation and release means to a recording medium.

The means for incorporating and releasing ionic dye molecules and the transferring means for transferring the ionic dye molecules to a recording medium can be easily controlled in a low-energy electrical manner, and do not generate any harmful substances such as ozone and nitrogen oxides.

DETAILED DESCRIPTION OF THE INVENTION

Figure 1:
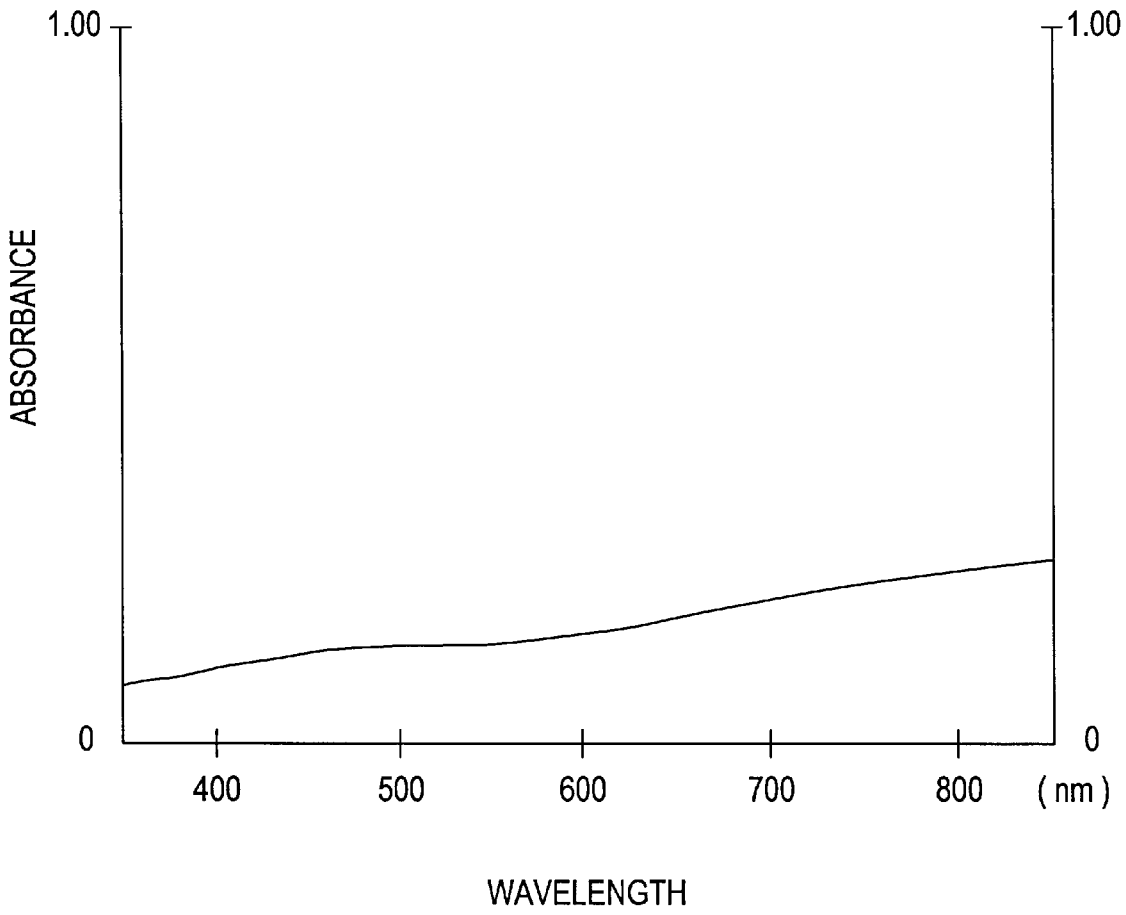
FIG. 1 is an absorption spectrum of a polypyrrole film formed on ITO through polymerization in the presence of NaCl.

The present invention is explained below in more detail. Any conducting polymer film can be used in the present invention as long as it is capable of being doped with ions and undoped through electrochemical oxidation and reduction. Examples of the film include films of various one-dimensional conducting polymers such as polyacetylenes, polydiacetylenes, polyheptadienes, polypyrroles, polythiophenes, polyanilines, polyphenylenevinylenes, polythiophenylenevinylenes, polyisothianephthenes, polyisonaphthothiophenes, poly(p-phenylene)s, poly (phenylene sulfide)s, poly(phenylene oxide)s, polyfurans, polyphenanthrenes, polyselenophenes, polytellurophenes, polyazulenes, polyindenes, polyindoles, polyphthalocyanines, polyacenes, polyacenoacenes, polynaphthylenes, polyanthracenes, polyperinaphthalenes, polybiphenylenes, polypyridinopyridines, polycyanodienes, and polyallenemethanoides. Examples of conducting polymers usable in the present invention further include ladder polymers, so-called pyropolymers, and two-dimensional conducting polymers such as graphite.

Various kinds of ionic dye molecules can be mostly utilized in the present invention. Examples of usable dyes include synthetic dyes such as acridine dyes, azaphthalide dyes, azine dyes, azulenium dyes, azo dyes, azomethine dyes, aniline dyes, amidinium dyes, alizarin dyes, anthraquinone dyes, isoindoline dyes, indigo dyes, indigoid dyes, indoaniline dyes, indolylphthalide dyes, oxazine dyes, carotenoid dyes, xanthine dyes, quinacridone dyes, quinazoline dyes, quinophthalone dyes, quinoline dyes, quinone dyes, guanidine dyes, chrome chelate dyes, chlorophyll dyes, ketonimine dyes, diazo dyes, cyanine dyes, dioxazine dyes, disazo dyes, diphenylmethane dyes, diphenylamine dyes, squarylium dyes, spyropyran dyes, thiazine dyes, thioindigo dyes, thiopyrylium dyes, thiofluoran dyes, triallylmethane dyes, trisazotriphenyl-methane dyes, triphenylmethane dyes, triphenylmethane-phthalide dyes, naphthalcyanine dyes, naphthoquinone dyes, naphthol dyes, nitroso dyes, bisazooxadiazole dyes, bisazo dyes, bisazostilbene dyes, bisazohydroxyperinone dyes, bisazofluorenone dyes, bisphenol dyes, bislactone dyes, pyrazolone dyes, phenoxazine dyes, phenothiazine dyes, phthalocyanine dyes, fluoran dyes, fluorene dyes, fulgide dyes, perinone dyes, perylene dyes, benzimidazolone dyes, benzopyran dyes, polymethine dyes, porphyrin dyes, methine dyes, merocyanine dyes, monoazo dyes, leucoauramine dyes, leucoxanthene dyes, and rhodamine dyes; and natural pigments represented by turmeric, gardenia, paprika, benikoji, lac, grape, beet, beefsteak plant, berry, corn, cabbage, and cacao pigments. In dye selection, the solubility and other properties of dye molecules should be taken in account according to the properties of the polymer film and the environment including the medium where a process is carried out.

The conducting polymer thin film having the properties described above can be produced by polymerizing at least one monomer for the conducting polymer in the presence of ionic dye molecules. This polymerization is conducted most preferably by the electrolytic polymerization method. In the electrolytic polymerization method, at least one aromatic low-moleculer weight compound as a starting material for a conducting polymer thin film is electrochemically polymerized to form the conducting polymer thin film on an electrode substrate. Some aromatic halogen compounds can be polymerized by electrolytic reduction polymerization. In such electrolytic polymerization, the conducting polymer thin film being produced grows while maintaining its electrically neutral state containing counter ions incorporated therein during the polymerization.

In the electrochemical formation of a conducting polymer film, a monomer for the conducting polymer is polymerized in the presence of ions which are either dye ions or ions comparable thereto in properties and molecular weight. As a result, a conducting polymer thin film which is capable of being doped with or undoped of ionic dye molecules and can be produced. That is, in the case where a monomer for a conducting polymer is polymerized in the presence of ions akin to ionic dye molecules in, for example, ionicity (substituent), stereostructure, molecular weight, etc., a film which is capable of being doped with or undoped of ionic dye molecules can be formed. The conducting polymer thin film thus obtained through polymerization can be more reversibly doped with and undoped of more kinds of ionic dye molecules upon electrochemical oxidation and reduction than films produced in the presence of low-molecular weight ions. Consequently, in the case where a conducting polymer (powder or solution) which is not in the form of a thin film deposited on an electrode is formed into a thin film, the resulting conducting polymer thin film need not be in the state doped with ionic dye molecules.

Besides the electrochemical electrolytic polymerization described above, techniques usable for producing these polymer films include vapor-phase, liquid-phase, or solid-phase chemical polymerization using a polymerization initiator, e.g., a catalyst, various coating techniques used for applying the chemically produced polymer, and modification techniques such as a pyrolysis treatment using a catalyst and sintering.

In the present invention, a difference in ion-doped state between at least two of the oxidized, neutral, and reduced states of a conducting polymer thin film is utilized. Namely, anionic dye molecules or cationic dye molecules are used as the anions or cations with which the conducting polymer thin film is doped and undoped, whereby the ionic dye molecules are reversibly incorporated and kept in the conducting polymer thin film and are released therefrom and transferred to a recording material, e.g., paper. The amount of ions with which the conducting polymer film is doped depends on potential and time period for voltage application, i.e., the amount of charges.

It is therefore possible to continuously regulate the concentration of dye molecules in a conducting polymer thin film by controlling the amount of charges at a constant potential exceeding the threshold value. With respect to the undoping of the conducting polymer film, the concentration of the ionic dye molecules released from the conducting polymer thin film can be continuously regulated by controlling the amount of charges at a constant potential exceeding the threshold value. It is also possible to conduct the incorporation of ionic dye ions into a conducting polymer thin film and the release thereof from the conducting polymer thin film only in desired regions of the film by imparting a potential distribution to the conducting polymer thin film or to the substrate electrode.

The receiving material on which an image is formed with dye molecules by the undoping of the conducting polymer thin film may be paper or the like. The receiving material is not particularly limited as long as it takes up dye molecules together with a solvent to form a visible image.

Figure 2:
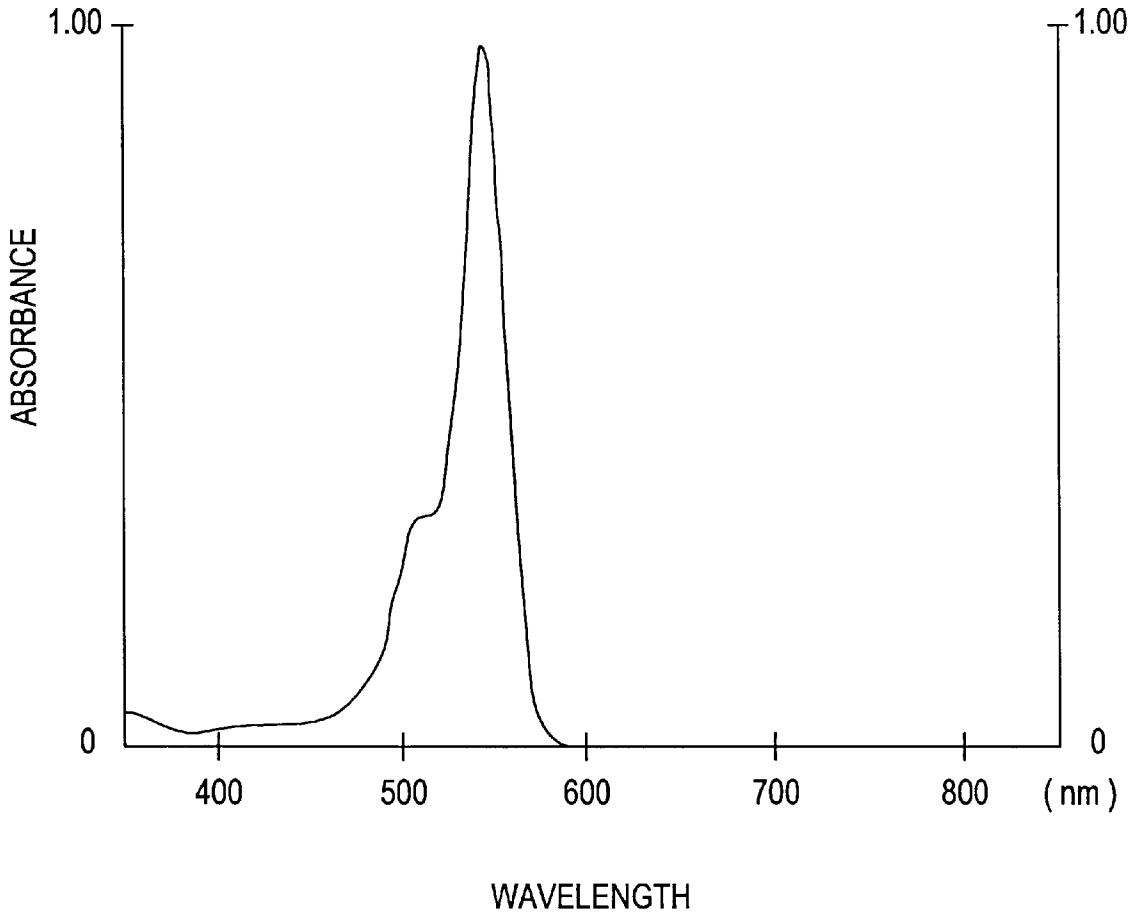
FIG. 2 is an absorption spectrum of an aqueous Rose Bengal solution.
Figure 3:
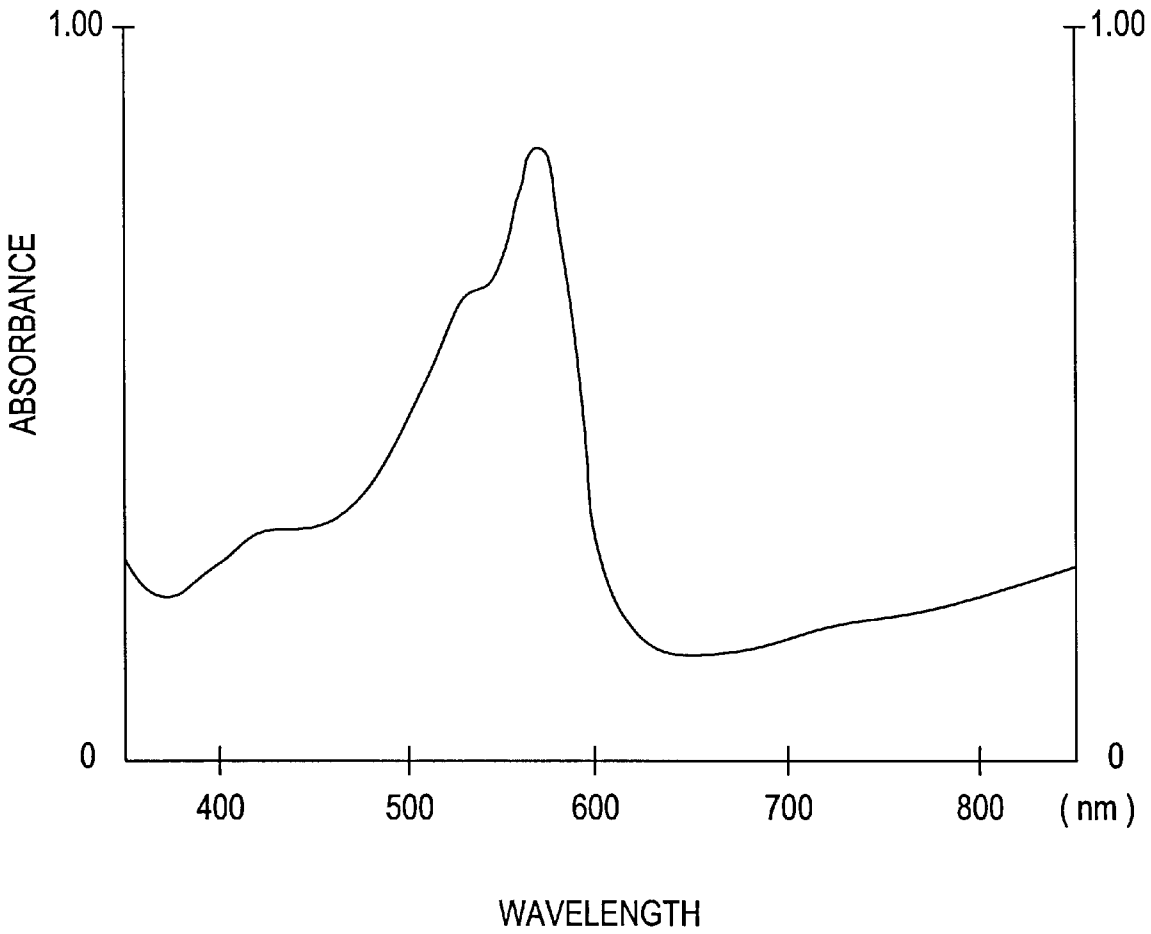
FIG. 3 is an absorption spectrum of a polypyrrole film formed on ITO through polymerization in Rose Bengal.

FIG. 1 is an absorption spectrum of a conducting polymer thin film (polypyrrole film) formed on ITO (indium-tin oxide) through polymerization in the presence of NaCl. FIG. 2 is an absorption spectrum of an aqueous Rose Bengal solution. FIG. 3 is an absorption spectrum of a conducting polymer thin film (polypyrrole film) formed through polymerization in Rose Bengal. The spectrum given in FIG. 3 has an absorption peak at 560 nm, which is not observed in FIG. 1, showing that Rose Bengal has been incorporated in the polypyrrole film.

Figure 4:
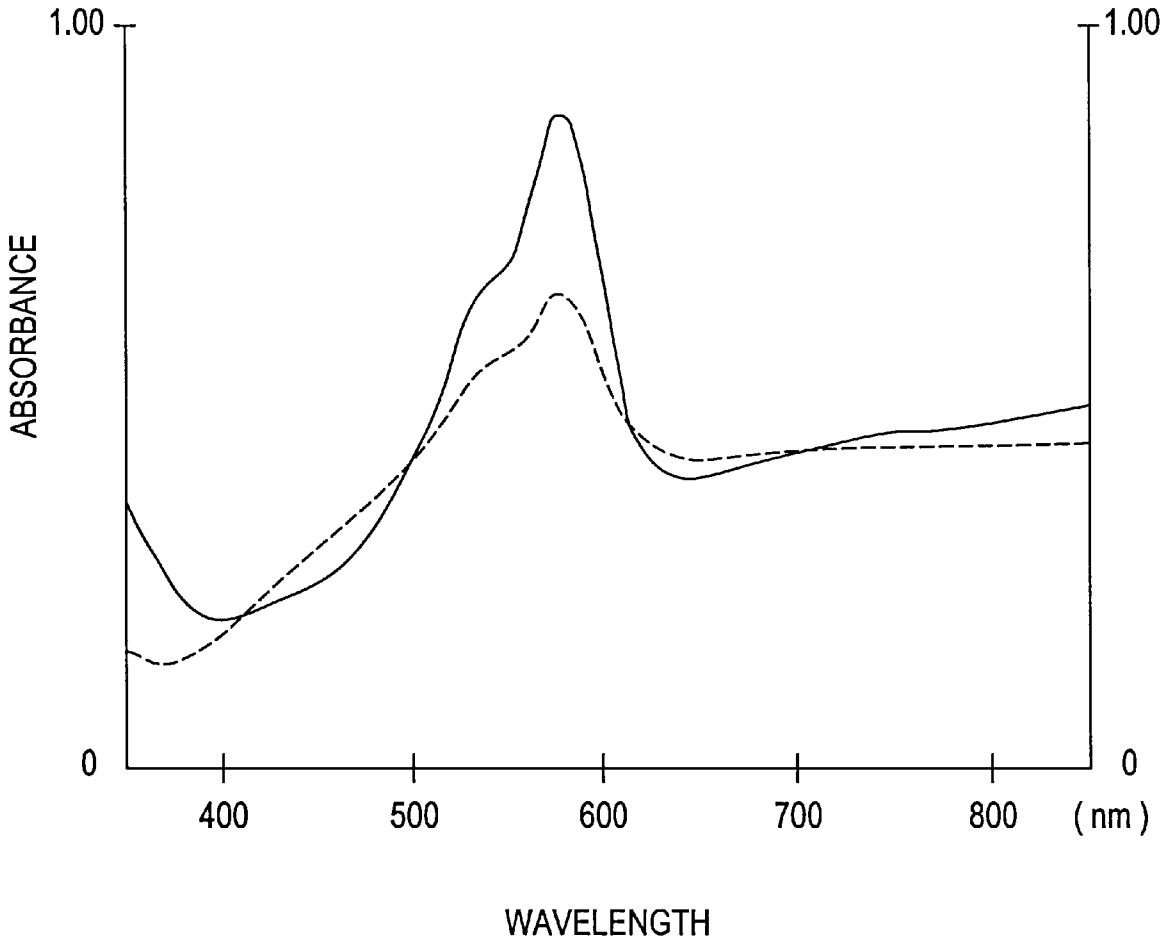
FIG. 4 is a graph showing the doping with Rose Bengal of a polypyrrole film formed through polymerization in Rose Bengal and undoping thereof.

FIG. 4 shows an absorption spectrum of a conducting polymer thin film (polypyrrole film) formed through polymerization in Rose Bengal (solid line) and an absorption spectrum thereof obtained after voltage application to the film on ITO under the conditions of −1.0 V and 30 seconds (broken line). That is, the solid line in FIG. 4 shows the conducting polymer thin film doped with Rose Bengal, while the broken line shows the conducting polymer thin film from which Rose Bengal has been released through undoping. FIG. 4 indicates that about 50% of the Rose Bengal has been released through undoping. It is however noted that when voltage is applied on platinum, which is more stable and has lower resistance, under the conditions of −1.0 V and 30 seconds, almost all the Rose Bengal is released through undoping. A quantitative evaluation revealed that polypyrrole is doped with one Rose Bengal molecule per five pyrrole monomer units.

Figure 5:
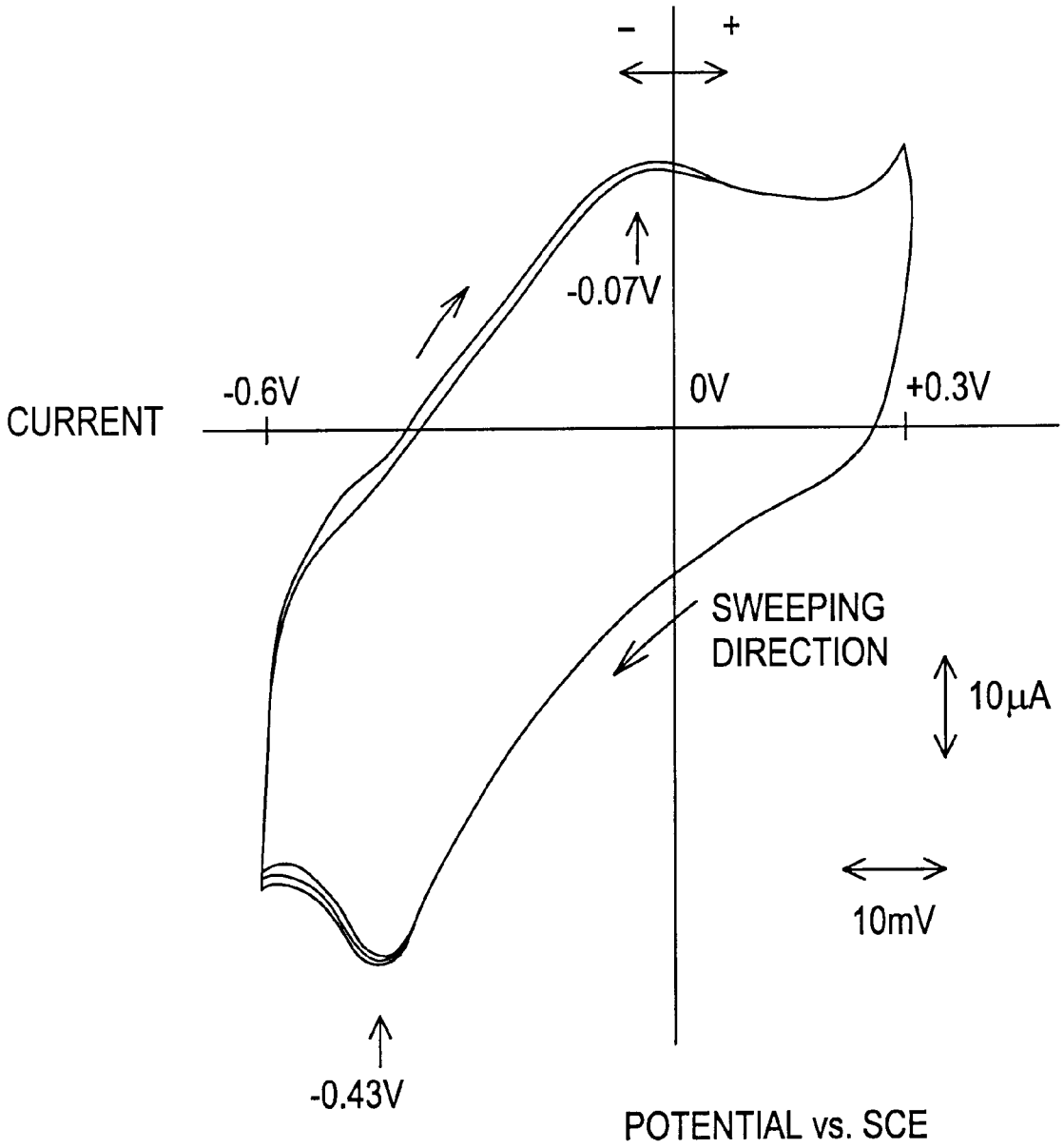
FIG. 5 is a cyclic voltammogram, in an aqueous Rose Bengal solution, of a polypyrrole film formed through polymerization in the presence of Rose Bengal.
Figure 6:
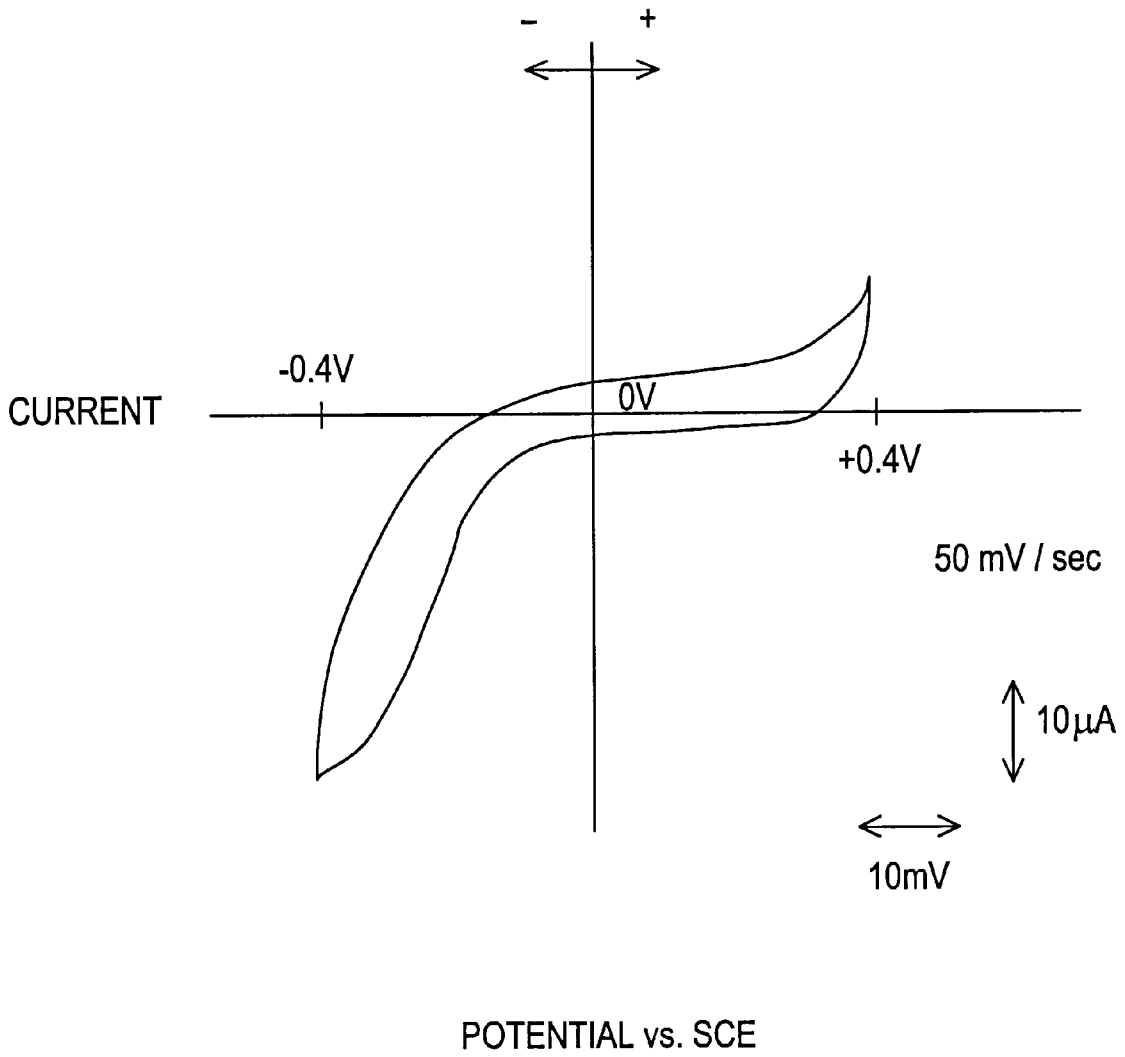
FIG. 6 is a cyclic voltammogram, in an aqueous Rose Bengal solution, of a polypyrrole film formed through polymerization in the presence of NaCl.

FIG. 5 shows a cyclic voltammogram, in an aqueous Rose Bengal solution, of a conducting polymer thin film (polypyrrole film) formed through polymerization in the presence of Rose Bengal. This voltammogram was obtained through an examination in which the polypyrrole film on platinum was immersed in an aqueous Rose Bengal solution and the potential of the platinum was repeatedly swept in the positive and negative directions against a saturated calomel electrode (reference) to measure the current. FIG. 6 shows a cyclic voltammogram, in an aqueous Rose Bengal solution, of a conducting polymer thin film (polypyrrole film) formed through polymerization in the presence of NaCl; the voltammogram shows the current which flowed when the potential was repeatedly swept at the same speed.

The voltammogram given in FIG. 5 has a current peak at −0.07 V attributable to oxidation and a current peak at −0.43 V attributable to reduction. FIG. 5 indicates that the film formed through polymerization in the presence of Rose Bengal is reversibly oxidized and neutralized (reduced) in a Rose Bengal solution, and that the film is reversibly doped with Rose Bengal and undoped. On the other hand, FIG. 6, in which the cyclic voltammogram has almost no peak, indicates that the conducting polymer thin film (polypyrrole film) formed through polymerization in the presence of NaCl cannot be sufficiently oxidized and reduced in an aqueous Rose Bengal solution. Namely, the latter film is inferior to the former in doping/undoping characteristics which show the degree of Rose Bengal incorporation in and release from a polymer matrix. Thus, differences among conducting polymer thin films in the property of being doped with anionic dye molecules and being undoped are made clear by cyclic voltammetry.

Figure 7:
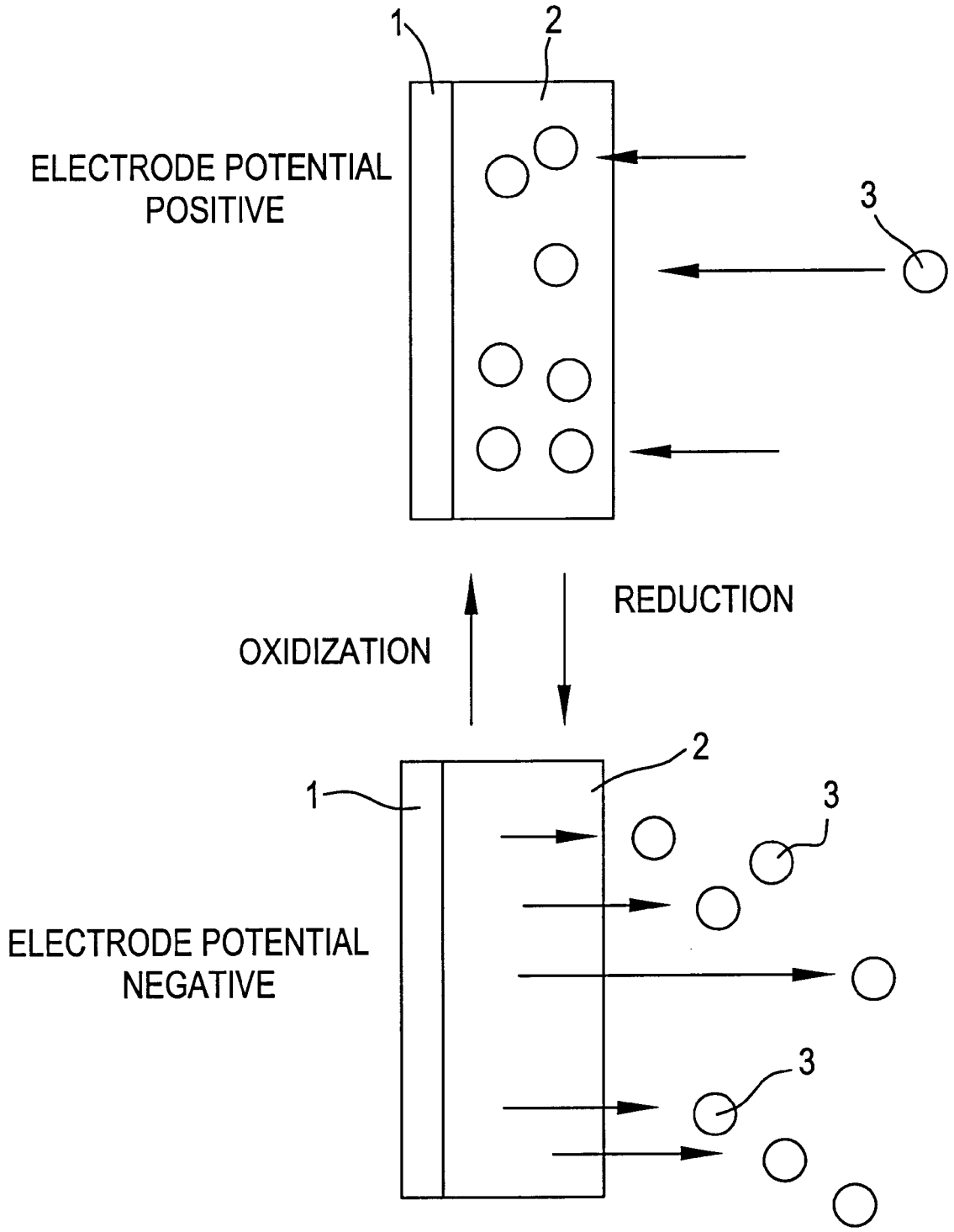
FIG. 7 is a view illustrating the doping of a conducting polymer thin film with an anionic dye by oxidation and the undoping of the conducting polymer thin film for release of the anionic dye by reduction, in the present invention.

The principle of doping with ions of ionic dye molecules and undoping in a conducting polymer thin film obtained by a method described above is shown in FIGS. 7 and 8, for which anionic dye molecules and cationic dye molecules were used respectively. In FIG. 7, numeral 1 denotes a substrate electrode, 2 a conducting polymer thin film (π-conjugated polymer), and 3 anionic dye molecules. For example, in the case where the conducting polymer thin film 2 was formed by electrolytic oxidation polymerization on an electrode regulated to have a positive potential, the conducting polymer thin film formed on the electrode substrate 1 is in an oxidized state and has been doped with anionic dye molecules 3. This conducting polymer thin film 2 is neutralized upon potential decrease to a negative value to thereby release the anionic dye molecules 3 serving to maintain the electrically neutral state, that is, the film is undoped. Upon potential increase to a positive value, the conducting polymer thin film 2 comes into an oxidized state and takes up anionic dye molecules 3 to maintain the electrically neutral state.

Figure 8:
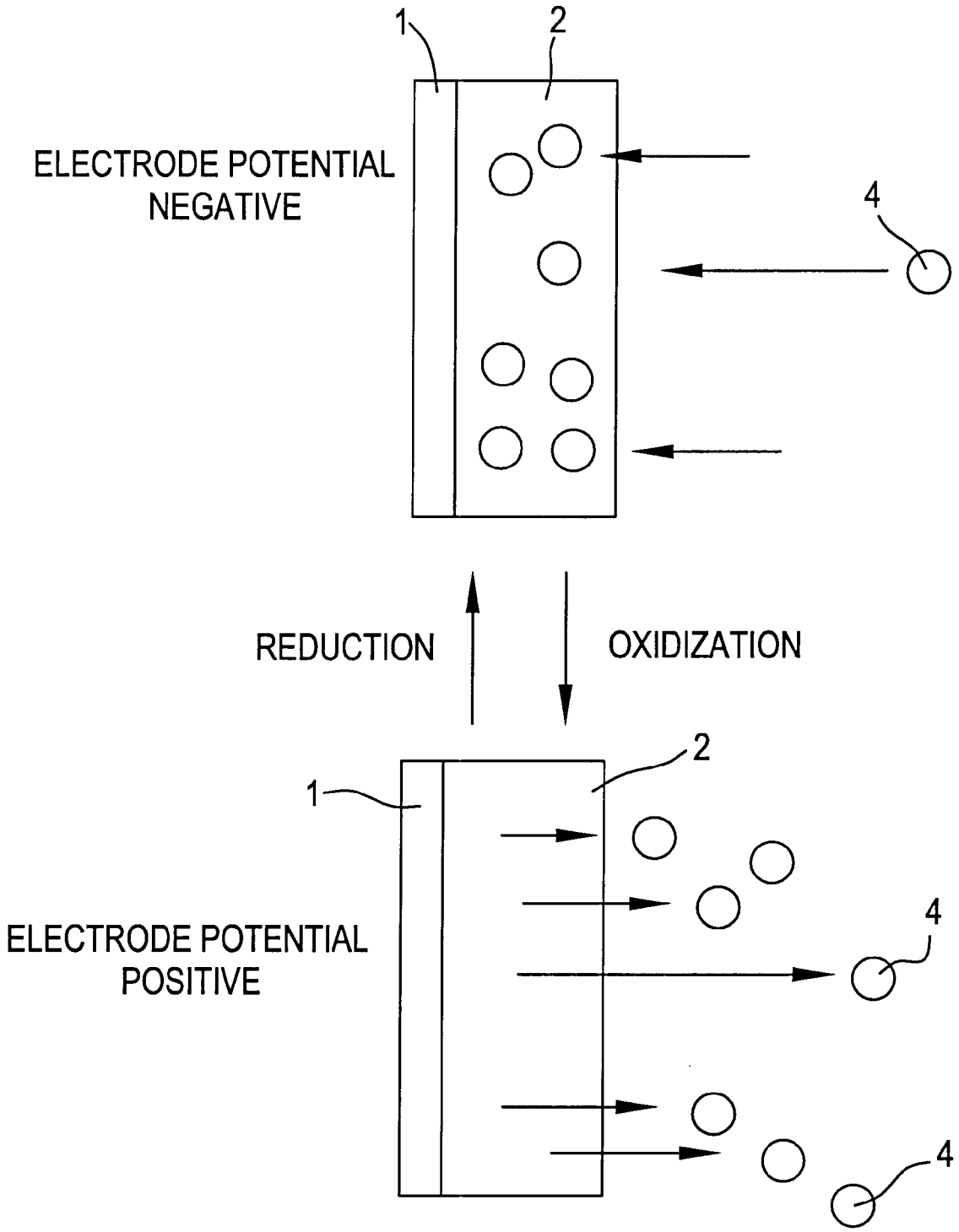
FIG. 8 is a view illustrating the doping of a conducting polymer thin film with a cationic dye by reduction and the undoping of the conducting polymer thin film for release of the cationic dye by oxidation, in the present invention.

In FIG. 8, numeral 1 denotes a substrate electrode, 2 a conducting polymer thin film (π-conjugated polymer), and 4 cationic dye molecules. This conducting polymer thin film 2 may be a thin film of any of some conducting polymers such as, e.g., polythiophene. In this case, upon potential decrease to a negative value, the conducting polymer thin film 2 comes into a reduced state and is doped with cationic dye molecules 4 to maintain the electrically neutral state. The cationic dye molecules thus incorporated serve to make the potential positive, and are released from the conducting polymer thin film 2 through undoping when the film 2 is returned to the neutral state.

The doping amount of dye molecule ions can be regulated by controlling the concentration of the dye molecule ions in an electrolyte solution, the potential of the electrode serving as a substrate for the conducting polymer film, and the time period for voltage application. Basically, the doping amount thereof is proportional to the amount of charges which flow during doping. Therefore, by oxidizing or reducing the conducting polymer film in an electrolyte solution containing dye molecule ions while regulating the potential of the substrate electrode, a conducting polymer thin film containing dye molecule ions in a high concentration can be obtained. In this operation, by regulating the potential of each of individual parts of the substrate electrode or by regulating the oxidized or reduced state of each of individual parts of the conducting polymer film, a dye molecule ion concentration image corresponding to any desired image can be formed as a doping density distribution in the conducting polymer film.

On the other hand, the conducting polymer film containing dye molecule ions incorporated therein is made to release the ions by applying a voltage in the direction reverse to that used for doping. In this case also, the release amount of dye molecule ions can be regulated by controlling the potential of the electrode, the electrical load imposed on the material by which the released ions are received, and the time period for release.

Figure 9:
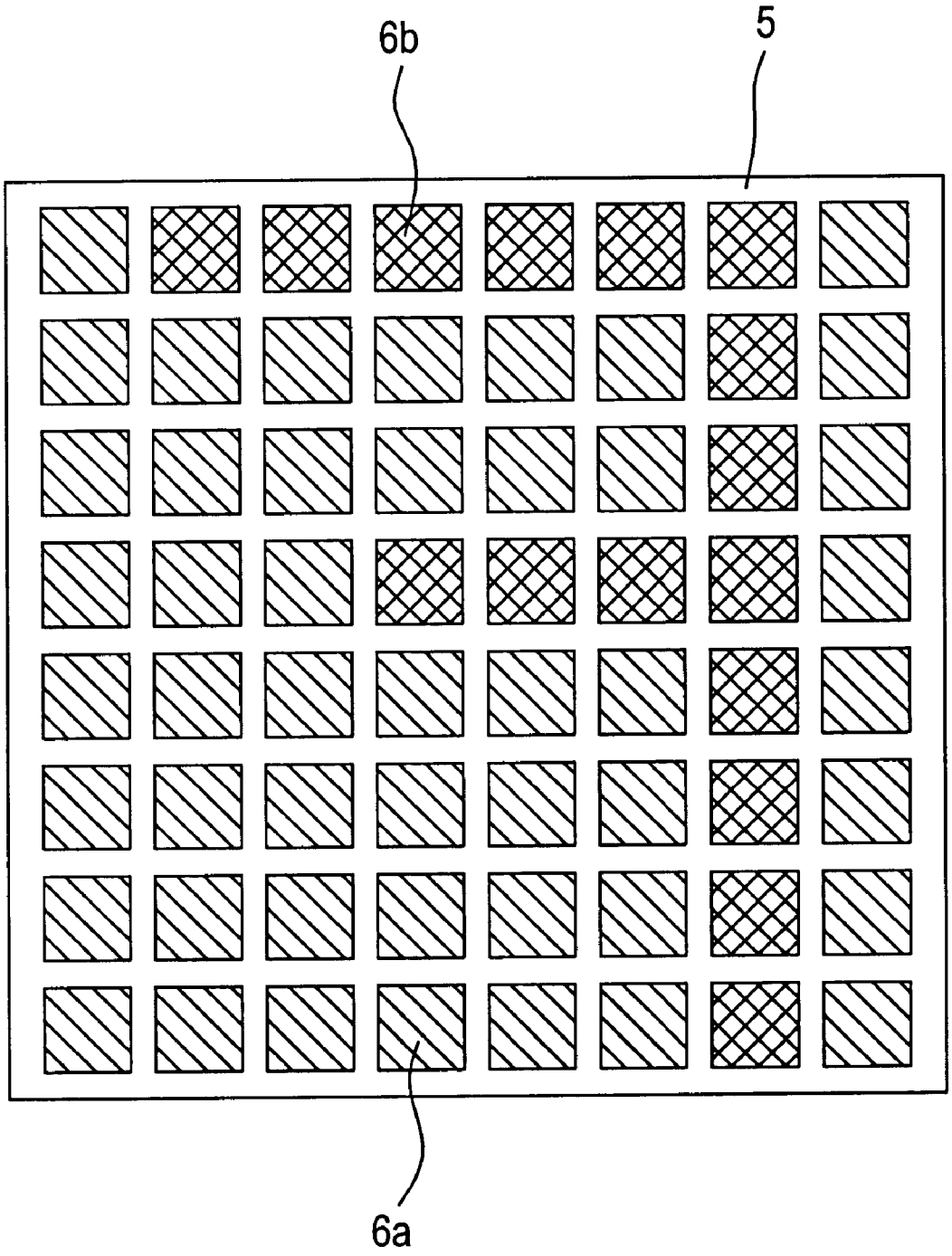
FIG. 9 is a view illustrating one embodiment of the image formation according to the present invention in which a polypyrrole film for marking formed on matrix electrodes is used.

Further, by varying the oxidized or reduced state of the conducting polymer film from part to part, a dye density image corresponding to any desired image can be formed on the surface of a receiving material, e.g., a recording medium, with the dye molecule ions released from the conducting polymer thin film. FIGS. 9 to 12 each is a view illustrating a method of image formation by working a conducting polymer thin film. FIG. 9 shows a matrix electrode substrate having a conducting polymer thin film formed thereon. The matrix electrode substrate 5 has matrix electrodes which respectively constitute desired areal units and the potential of each of which is capable of being independently regulated. In this matrix electrode substrate 5, the matrix electrodes comprise electrode regions **6*b* to which a voltage capable of causing undoping for the release of, e.g., Rose Bengal is applied and electrode regions 6*a* where the film has been doped with Rose Bengal. The electrode regions 6*a* where the film has been doped with Rose Bengal extend throughout the matrix electrode substrate 6, while the electrode regions 6*b* to which a voltage capable of causing undoping for Rose Bengal release is applied occupy regions corresponding to a desired image. Specifically, in the figure, the electrode regions 6*b*** to which a voltage capable of causing undoping for Rose Bengal release is applied constitute a letter region in the shape of a reversed letter F.

Subsequently, a receiving material sample 7, e.g., receiving paper, is brought into contact with the matrix electrode substrate 5, and the given voltage is applied to the electrode regions **6*b*. As a result, Rose Bengal is transferred to the receiving material sample 7 in regions 8 corresponding to the arrangement of the electrode regions 6*b***, whereby an image (letter F) can be formed.

Figure 11:
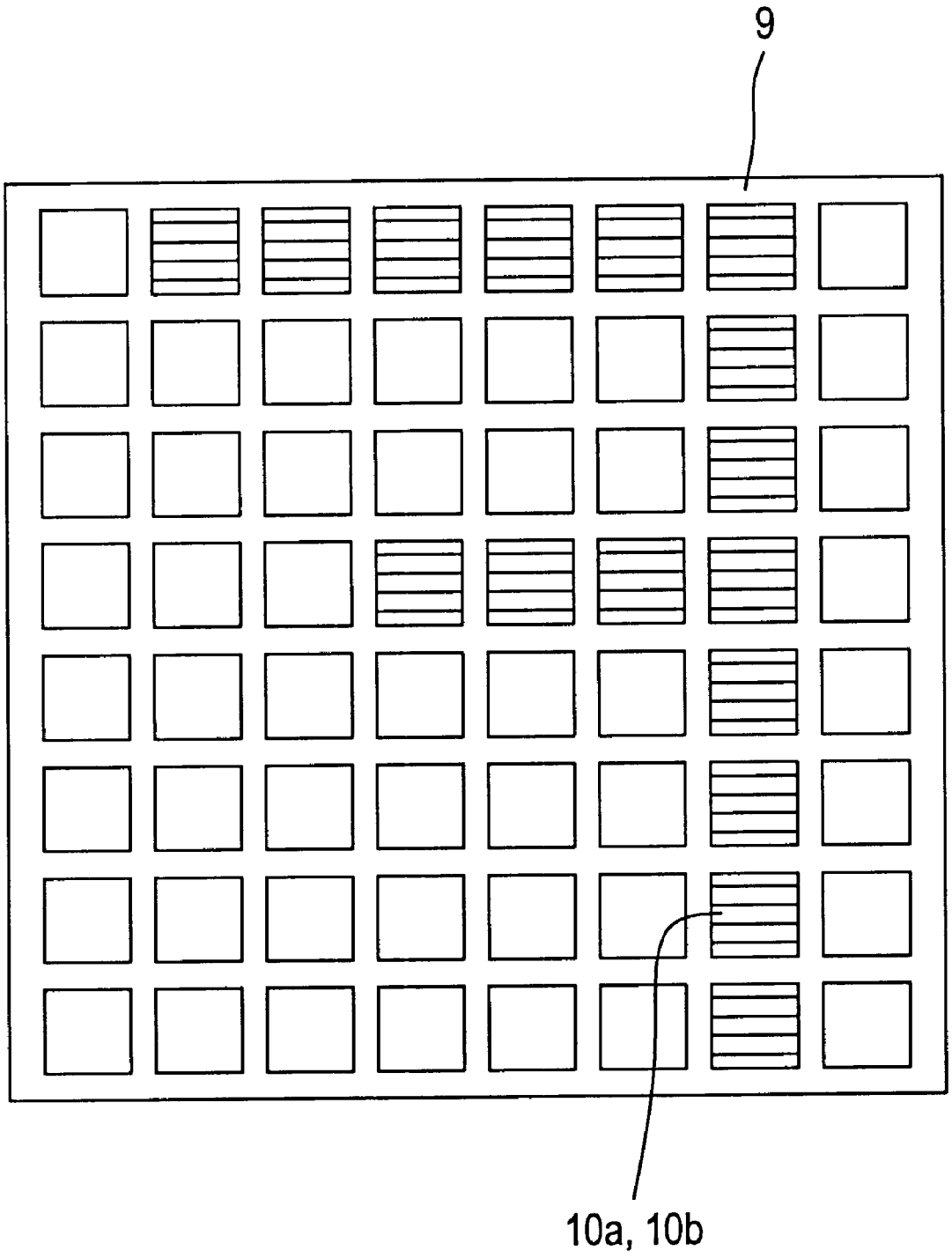
FIG. 11 is a view illustrating another embodiment of the image formation according to the present invention in which a polypyrrole film for marking formed on matrix electrodes is used.
Figure 12:
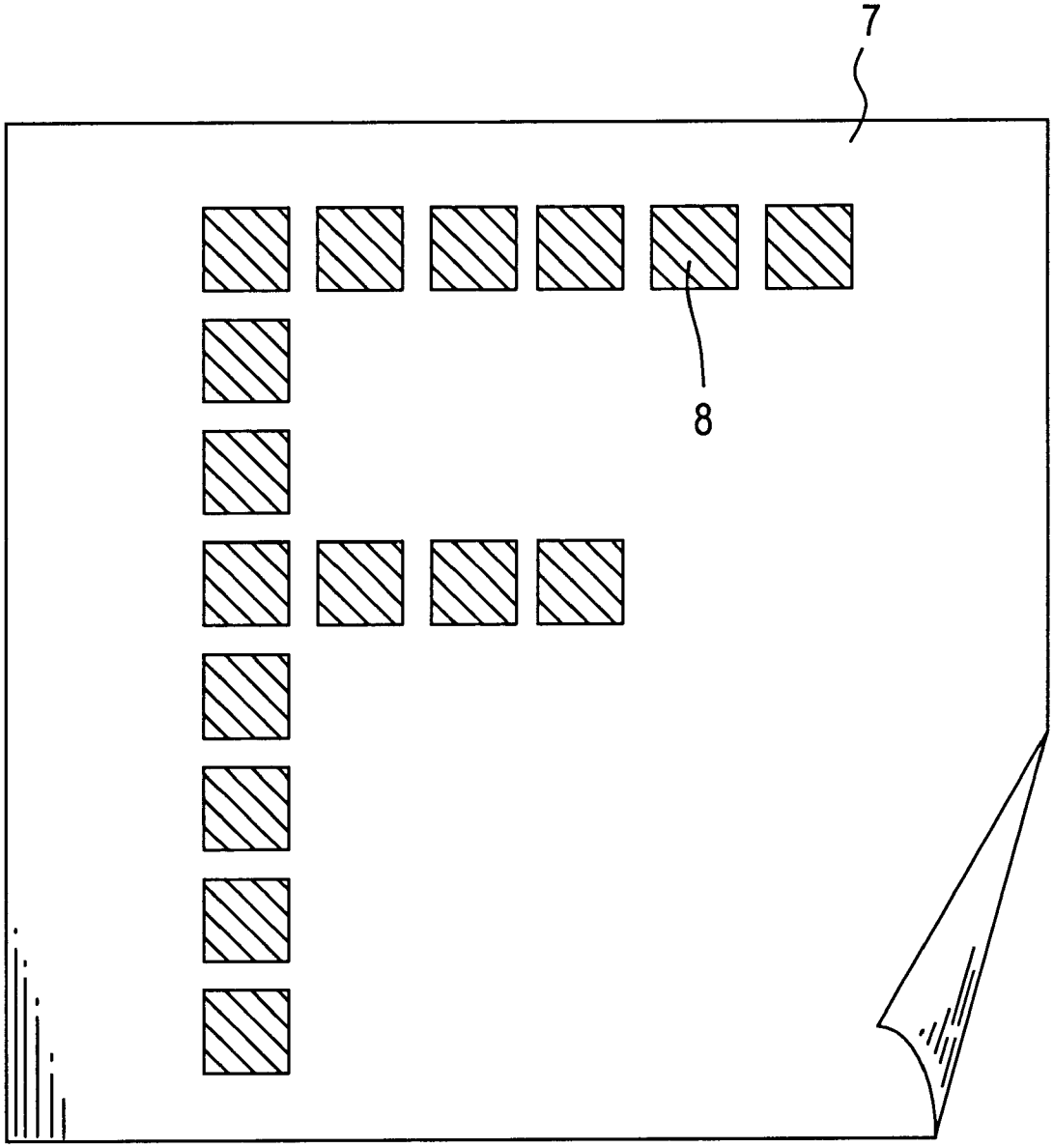
FIG. 12 is a view showing an image formed by transferring the image shown in FIG. 11.

FIG. 11 shows a matrix electrode substrate having a conducting polymer thin film formed thereon. The matrix electrode substrate 9 has matrix electrodes which respectively constitute desired areal units and the potential of each of which is capable of being independently regulated. In this matrix electrode substrate 9, the matrix electrodes serve as electrode regions **10*a* to which a voltage capable of causing doping with, e.g., Rose Bengal is applied and electrode regions 10*b* where the film has been doped with Rose Bengal. In this matrix electrode substrate, the electrode regions 10*a* to which a voltage capable of causing doping with Rose Bengal is applied are the electrode regions 10*b* where the film has been doped with Rose Bengal. In the figure, the electrode regions 10*a* and 10*b*** constitute a letter region in the shape of a reversed letter F.

Subsequently, a receiving material sample 7, e.g., receiving paper, is brought into contact with the matrix electrode substrate 9, and the given voltage capable of causing undoping is applied to the electrode regions **10*a*. As a result, Rose Bengal is transferred to the receiving material sample 7 in regions 8 corresponding to the arrangement of the electrode regions 10*a***, whereby an image (letter F) can be formed.

As described above, the image formation according to the present invention can be accomplished with any of three techniques: to impart a doping density distribution during doping; to impart a release density distribution during release; and a combination of both.

Figure 13:
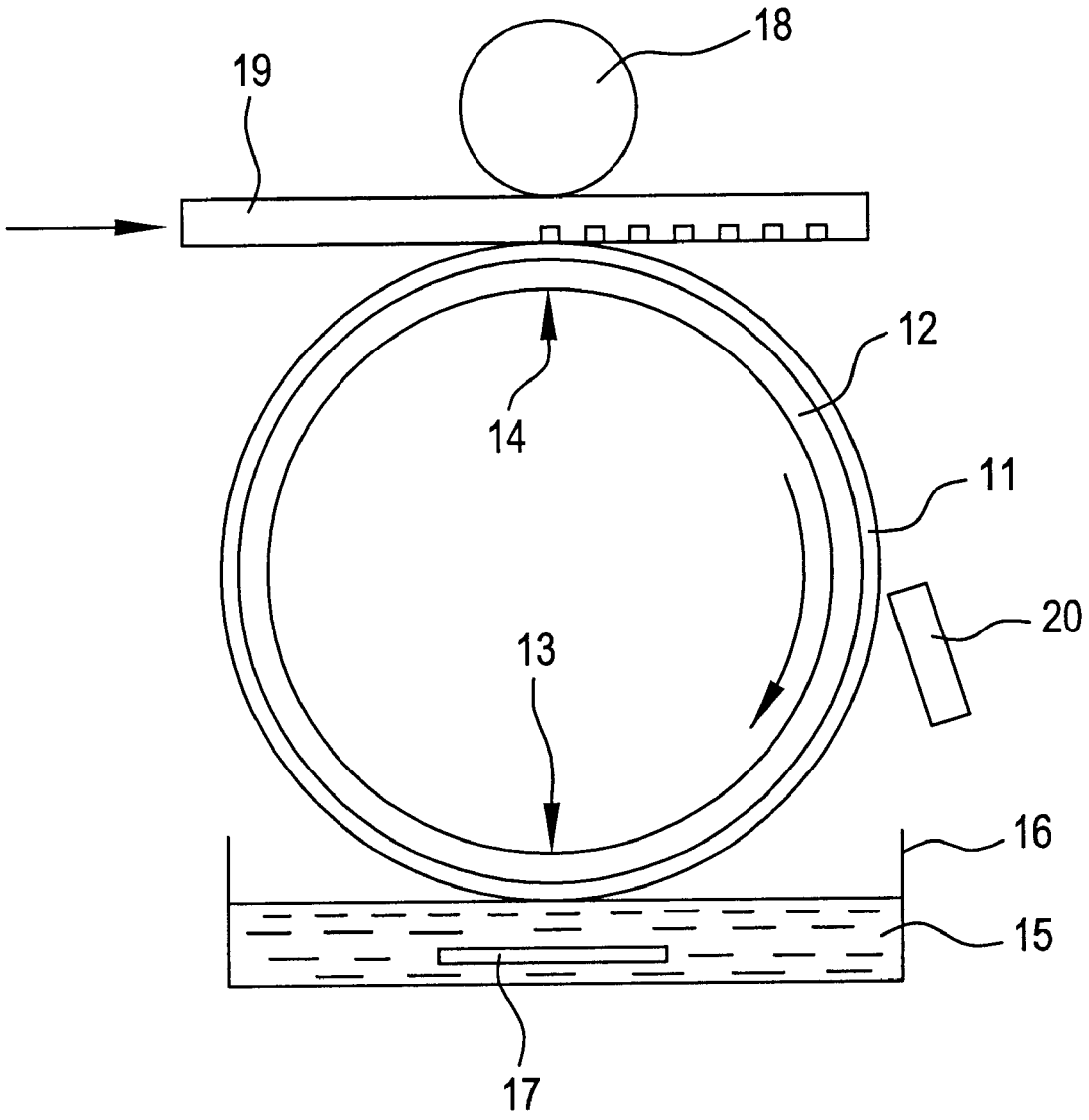
FIG. 13 is a schematic illustration view showing one embodiment of the apparatus for image formation according to the present invention.

FIG. 13 shows one embodiment of an apparatus for image formation suitable for continuous transfer. The apparatus shown in FIG. 13 comprises a matrix electrode cylinder 12, which has a conducting polymer thin film 11 formed on the surface thereof and which is provided inside with an incorporation potential working electrode 13 for incorporating ionic dye molecules into the conducting polymer thin film and a transfer potential working electrode 14 for releasing the ionic dye molecules incorporated in the conducting polymer thin film. Beneath the matrix electrode cylinder 12 has been disposed a tank 16 containing a dye electrolyte solution 15 containing ionic dye molecules dissolved therein. Within the tank 16 has been disposed a counter electrode for incorporation 17 facing the incorporation potential working electrode 13. At a predetermined distance from the surface of the matrix electrode cylinder 12 has been disposed a counter electrode for transfer 18 in such a manner that receiving paper 19 can pass through the space between the matrix electrode cylinder 12 and the counter electrode for transfer 18. Further, a cleaning blade 20 has been disposed which is in contact with the matrix electrode cylinder 12.

In this image-forming apparatus, a voltage capable of incorporating ionic dye molecules is applied between the incorporation potential working electrode 13 and the counter electrode for incorporation 17. As a result, ionic dye molecules contained in the dye electrolyte solution 15 are incorporated into predetermined regions of the conducting polymer thin film 11 on the matrix electrode cylinder 12. Subsequently, the excess liquid present on the surface of the matrix electrode cylinder 12 is removed with the cleaning blade 20. While the matrix electrode cylinder 12 is kept being rotated, a voltage capable of releasing the ionic dye molecules incorporated in the conducting polymer thin film 11 is applied between the transfer potential working electrode 14 and the counter electrode for transfer 18. As a result, the ionic dye molecules are transferred to predetermined regions of the surface of receiving paper 19 to form an image.

In this apparatus for image formation, the conducting polymer thin film 11 is selectively doped with ionic dye molecules in the regions thereof corresponding to desired electrodes among the electrodes arranged on the matrix electrode cylinder 12, and the conducting polymer thin film 11 is then undoped to release the ionic dye molecules, whereby a predetermined image can be obtained. By replenishing the electrolyte solution containing dye molecules so as to keep the tank 16 being filled with the solution, continuous image formation is possible.

EXAMPLE 1

Using a three-pole electrolytic apparatus shown in FIG. 14 which had a potentiostat 21 and, connected thereto, a reference electrode (saturated calomel electrode) 22, a counter electrode (platinum plate electrode) 23, and a working electrode (platinum plate electrode) 24, pyrrole as a monomer for a conducting polymer was polymerized as follows. The potential of the working electrode 24 was maintained at +0.8 V based on the saturated calomel electrode 22 for 30 seconds in an aqueous solution 25 containing 0.06 M pyrrole as a monomer for a conducting polymer and 0.02 M Rose Bengal as an anionic dye. As a result, a thin polypyrrole film was obtained on the working electrode 24 by the electrolytic oxidation polymerization of pyrrole. This thin polypyrrole film was of a purplish red color because the film formed had been doped with Rose Bengal.

Figure 15:
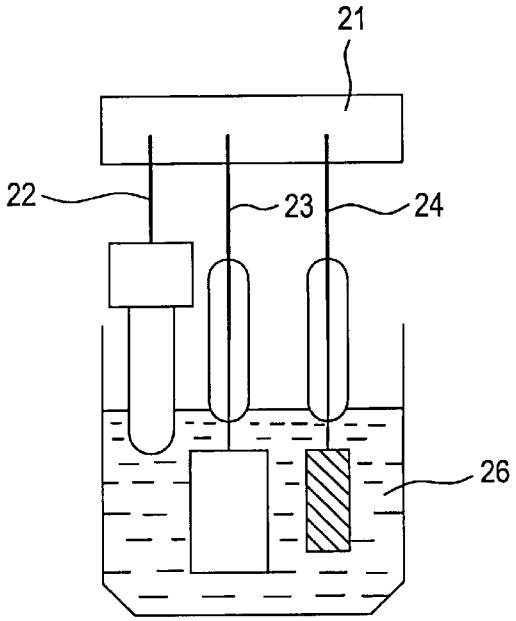
FIG. 15 is a view illustrating an experiment conducted for showing another embodiment in Example 1 of the present invention.

In the above three-pole electrolytic apparatus, the potential of the working electrode 24 covered with the thin polypyrrole film was repeatedly swept in the range of from +0.4 to −0.8 V based on the saturated calomel electrode 22 in an aqueous solution 26 containing 0.02 M Rose Bengal alone, as shown in FIG. 15. As a result, a maximum current value was observed at −0.4 V during sweeping from positive to negative voltages, and another maximum current value was observed at −0.2 V during sweeping from negative to positive voltages. It was ascertained from the above results that doping of the thin polypyrrole film with Rose Bengal anions and undoping thereof could be reversibly conducted.

Figure 16:
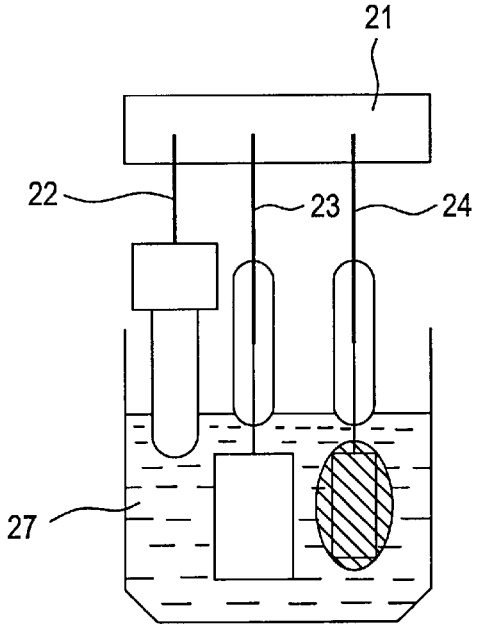
FIG. 16 is a view illustrating an experiment conducted for showing still another embodiment in Example 1 of the present invention.

The thin polypyrrole film in which Rose Bengal anions had been fully incorporated at 0.4 V was washed with pure water, and then immersed in 0.1 M aqueous sodium chloride solution 27 as shown in FIG. 16. No change occurred as long as no electrical stimulus was given. When a voltage of −1.0 V based on the saturated calomel electrode 22 was applied, Rose Bengal anions were released from the thin polypyrrole film to color the aqueous sodium chloride solution. This aqueous sodium chloride solution was returned to the solution shown in FIG. 15, which contained 0.06 M pyrrole and 0.02 M Rose Bengal, and a voltage of +0.4 V based on the saturated calomel electrode 22 was applied. As a result, the thin polypyrrole film on the working electrode 24 assumed a purplish red color, showing that Rose Bengal was incorporated again.

EXAMPLE 2

In the same three-pole electrolytic apparatus as in Example 1, the potential of the working electrode 24 was maintained at +0.8 V based on the saturated calomel electrode 22 for 30 seconds in an aqueous solution containing 0.06 M pyrrole as a monomer for a conducting polymer and 0.1 M sodium chloride. As a result, a thin polypyrrole film was obtained on the working electrode 24 by the electrolytic oxidation polymerization of pyrrole. This thin polypyrrole film was of a violaceous color because this film had not been doped with Rose Bengal.

Using the three-pole electrolytic apparatus, the potential of the working electrode 24 covered with the thin polypyrrole film was repeatedly swept in the range of from +0.4 to −0.8 V based on the saturated calomel electrode 22 in an aqueous solution containing 0.02 M Rose Bengal only. As a result, a maximum current value was observed at −0.5 V during sweeping from positive to negative voltages, and another maximum current value was observed at −0.2 V during sweeping from negative to positive voltages. In the potential sweeping at the same speed as in Example 1, the current maximums were about a half of the corresponding current maximums in Example 1. This shows that in the thin polypyrrole film formed through polymerization in the presence of sodium chloride, doping with Rose Bengal anions and undoping occurred but the rates thereof were low. The thin polypyrrole film was taken out of the solution when the potential was +0.4 V, at which the film was in a completely oxidized state. As a result, this thin polypyrrole film was of a purplish red color, showing that it had been doped with Rose Bengal. It was ascertained from the above results that the thin polypyrrole film formed through polymerization in the presence of sodium chloride reversibly underwent doping with Rose Bengal and undoping.

EXAMPLE 3

Figure 17:
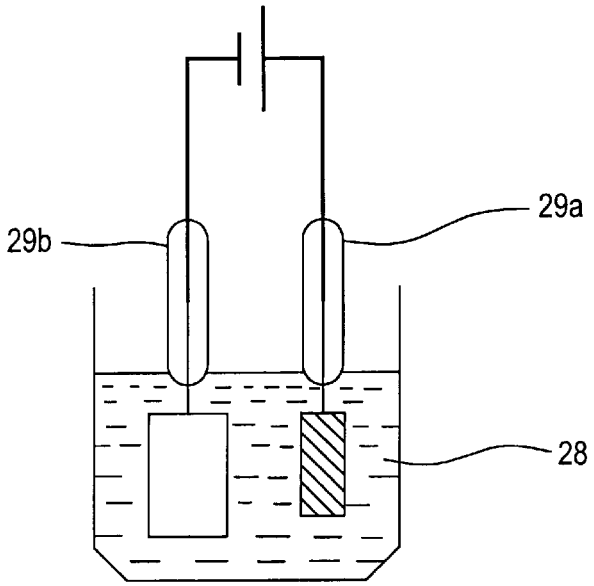
FIG. 17 is a view illustrating an experiment conducted for showing one embodiment in Example 3 of the present invention.
Figure 18:
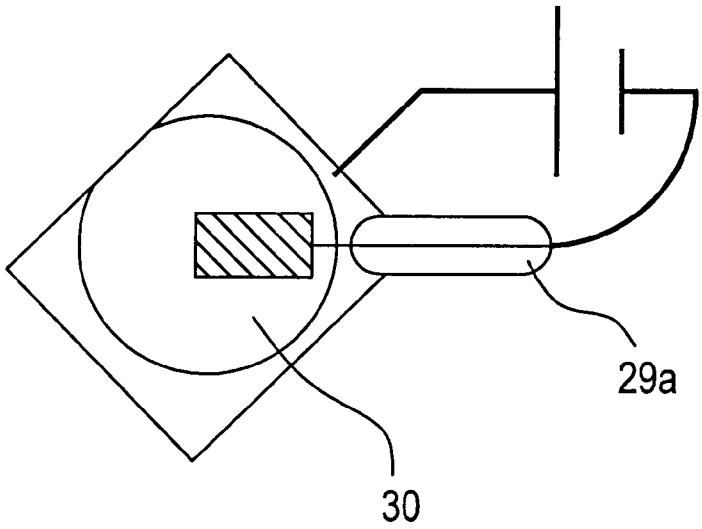
FIG. 18 is a view illustrating an experiment conducted for showing another embodiment in Example 3 of the present invention.
Figure 19:
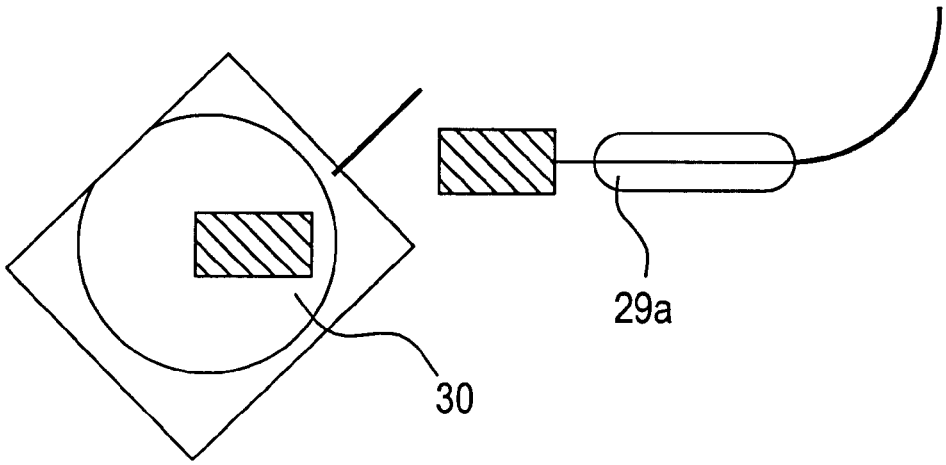
FIG. 19 is a view illustrating an experiment conducted for showing still another embodiment in Example 3 of the present invention.

As shown in FIG. 17, two platinum plate electrodes **29*a* and 29*b* were immersed in an aqueous solution 28 containing 0.06 M pyrrole and 0.02 M Rose Bengal, and a voltage of 1.5 V was applied between the electrodes for 10 seconds with a dry battery of size AA. As a result, a thin polypyrrole film was obtained on the positive-side platinum electrode 29*a* by the electrolytic oxidation polymerization of pyrrole. This thin polypyrrole film was of a purplish red color because the film had been doped with Rose Bengal. After the electrode 29*a* covered with the thin polypyrrole film was washed with pure water, a filter paper 30 dampened with 0.1 M aqueous sodium chloride solution was placed between the electrode 29*a* and the platinum plate electrode 29*b* as shown in FIG. 18. Mere contact of the filter paper 30 with the thin polypyrrole film did not result in coloring of the filter paper at all. However, when a voltage of 1.5 V was applied for 10 seconds with a dry battery in the reverse direction as the above, i.e., using the electrode 29*a* covered with the thin polypyrrole film as the negative terminal, the filter paper 30 was colored in the shape of the covered electrode as shown in FIG. 19. It was ascertained from the above results that Rose Bengal could be electrically transferred to the filter paper 30** by undoping the thin polypyrrole film to release the Rose Bengal anions. Further, the electrode covered with the thin polypyrrole film was superposed on a platinum plate electrode, and a dampened filter paper was placed on the thin polypyrrole film in such a manner that the filter paper was also in contact with the platinum plate electrode. In this case also, the filter paper was colored in the shape of the covered electrode. It was ascertained from the above results that dye molecules were released from both sides of the electrode covered with the thin polypyrrole film, as long as the covered electrode was in contact with a dye-receiving material and an electric field was applied thereto.

EXAMPLE 4

A thin polypyrrole film doped with Rose Bengal was formed in the same manner as in Example 3. A filter paper dampened with pure water was placed between the electrode covered with the thin polypyrrole film and a platinum plate electrode, and a voltage of 1.5 V was applied to the assemblage for 10 seconds with a dry battery, using the electrode covered with the thin polypyrrole film as the negative terminal. As a result, the filter paper was colored in the shape of the covered electrode. It was thus ascertained that Rose Bengal could be electrically transferred even to the filter paper dampened with pure water. However, the filter paper dampened with pure water underwent more Rose Bengal blurring than the filter paper dampened with 0.1 M aqueous sodium chloride solution.

EXAMPLE 5

Figure 14:
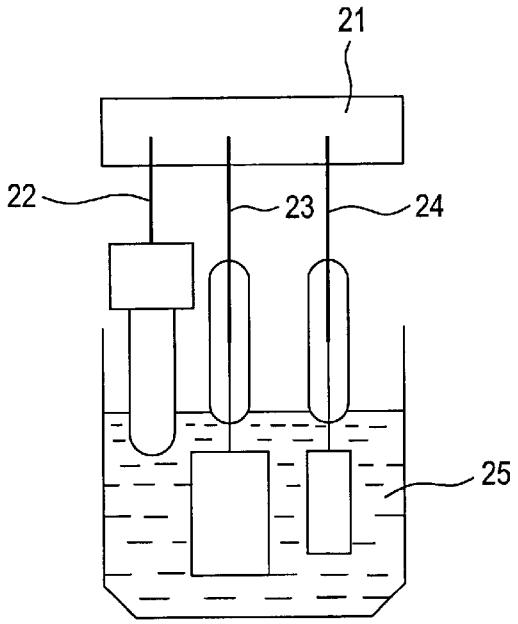
FIG. 14 is a view illustrating an experiment conducted for showing one embodiment in Example 1 of the present invention.

Using the same three-pole electrolytic apparatus shown in FIG. 14 as in Example 1, pyrrole was polymerized in an aqueous solution 25 containing 0.06 M pyrrole and 0.02 M Rose Bengal at a potential of +0.8 V based on the saturated calomel electrode 22 for each of various periods ranging from 5 to 200 seconds. The amount of charges passed was proportional to the time for polymerization. Thus, thin films respectively having thicknesses corresponding to the amounts of charges were formed on the respective platinum electrodes. Using the three-pole electrolytic apparatus, each of the thus-formed polypyrrole films was immersed in 0.1 M aqueous sodium chloride solution and a voltage of −1.0 V based on the saturated calomel electrode was applied. As a result, Rose Bengal was released from each polypyrrole film to color the aqueous sodium chloride solution. The individual aqueous sodium chloride solutions released from the electrodes were compared in absorbance at 550 nm, at which Rose Bengal has an absorption peak. As a result, it was ascertained that the release amount of Rose Bengal increased in proportion to polymerization time. The above results show that the polypyrrole films having different thicknesses each had been evenly doped with Rose Bengal. The density of Rose Bengal in the doped polypyrrole films was one Rose Bengal molecule per three pyrrole monomer units.

EXAMPLE 6

Using the same three-pole electrolytic apparatus shown in FIG. 14 as in Example 5, pyrrole was polymerized in an aqueous solution 25 containing 0.06 M pyrrole and 0.02 M Rose Bengal at a potential of +0.8 V based on the saturated calomel electrode 22 for 30 seconds. A voltage of −1.0 V based on the saturated calomel electrode 22 was applied to the resulting polypyrrole film in an aqueous solution of 0.02 M Rose Bengal to release Rose Bengal once, and the polypyrrole film was then doped again with Rose Bengal anions at each of various potentials ranging from −0.2 to +0.4 V for 10 seconds. Each of these polypyrrole films was immersed in 0.1 M aqueous sodium chloride solution, and a voltage of −1.0 V based on the saturated calomel electrode 22 was applied thereto for 10 seconds. As a result, Rose Bengal was released from each polypyrrole film to color the aqueous sodium chloride solution. The individual aqueous sodium chloride solutions released from the electrodes were compared in absorbance at 550 nm, at which Rose Bengal has an absorption peak. As a result, it was ascertained that the release amount of Rose Bengal increased depending on doping potential. The above results show that even in polypyrrole films having the same thickness, the concentration of Rose Bengal can be regulated by controlling the potential for doping.

EXAMPLE 7

Using the same three-pole electrolytic apparatus shown in FIG. 14 as in Example 5, pyrrole was polymerized in an aqueous solution 25 containing 0.06 M pyrrole and 0.02 M Rose Bengal at a potential of +0.8 V based on the saturated calomel electrode 22 for 30 seconds. A voltage of −1.0 V based on the saturated calomel electrode 22 was applied to the resulting polypyrrole film in an aqueous solution of 0.02 M Rose Bengal to release Rose Bengal once, and the polypyrrole film was then doped again with Rose Bengal anions at a potential of +0.4 V for each of various periods ranging from 0.5 to 10 seconds. Each of these polypyrrole films was immersed in 0.1 M aqueous sodium chloride solution, and a voltage of −1.0 V based on the saturated calomel electrode 22 was applied thereto for 10 seconds. As a result, Rose Bengal was released from each polypyrrole film to color the aqueous sodium chloride solution. The individual aqueous sodium chloride solutions released from the electrodes were compared in absorbance at 550 nm, at which Rose Bengal has an absorption peak. As a result, it was ascertained that the release amount of Rose Bengal increased depending on doping time. The above results show that even in polypyrrole films having the same thickness, the concentration of Rose Bengal can be regulated by controlling the time for doping.

EXAMPLE 8

Using the same three-pole electrolytic apparatus shown in FIG. 14 as in Example 1, pyrrole was polymerized in an aqueous solution 25 containing 0.06 M pyrrole and 0.02 M Rose Bengal at a potential of +0.8 V based on the saturated calomel electrode 22 for 30 seconds. Thus, films containing Rose Bengal in an amount corresponding to the amount of charges passed were formed on respective platinum electrodes. Using the three-pole electrolytic apparatus shown in FIG. 14, each of the thus-formed polypyrrole films was immersed in 0.1 M aqueous sodium chloride solution and a voltage of −1.0 V based on the saturated calomel electrode 22 was applied for various periods of from 0.2 to 10 seconds. As a result, each aqueous sodium chloride solution was colored depending on the amount of Rose Bengal released from the polypyrrole film. The aqueous sodium chloride solutions were compared in the release amount of Rose Bengal by examining the absorbance thereof at 550 nm, at which Rose Bengal has an absorption peak. As a result, it was ascertained that the release amount of Rose Bengal increased depending on the time for −1.0 V application. The above results show that the amount of Rose Bengal released from polypyrrole films having the same thickness and the same Rose Bengal concentration can be regulated by controlling the time for potential application.

EXAMPLE 9

Using the same three-pole electrolytic apparatus shown in FIG. 14 as in Example 1, pyrrole was polymerized in an aqueous solution 25 containing 0.06 M pyrrole and 0.02 M Rose Bengal at a potential of +0.8 V based on the saturated calomel electrode 22 for 30 seconds. Thus, films containing Rose Bengal in an amount corresponding to the amount of charges passed were formed on respective platinum electrodes. Using the three-pole electrolytic apparatus shown in FIG. 14, each of the thus-formed polypyrrole films was immersed in 0.1 M aqueous sodium chloride solution and each of various voltages ranging from −0.2 to 1.0 V based on the saturated calomel electrode 22 was applied for 10 seconds. As a result, each aqueous sodium chloride solution was colored depending on the amount of Rose Bengal released from the polypyrrole film. The aqueous sodium chloride solutions were compared in the release amount of Rose Bengal by examining the absorbance thereof at 550 nm, at which Rose Bengal has an absorption peak. As a result, it was ascertained that the release amount of Rose Bengal increased depending on the potential applied. The above results show that the amount of Rose Bengal released from polypyrrole films having the same thickness and the same Rose Bengal concentration can be regulated by controlling the potential applied.

EXAMPLE 10

A platinum plate electrode was immersed for 1 hour in an aqueous solution containing 0.01 M iron chloride ($FeCl_3$) and 0.1 M pyrrole. As a result, pyrrole polymerized in the solution and part of the polymer deposited on the platinum plate electrode. Using the three-pole electrolytic apparatus shown in FIG. 14, the potential of the electrode covered with the thin polypyrrole film was repeatedly swept in the range of from +0.4 to −0.8 V based on the saturated calomel electrode 22 in an aqueous solution containing 0.02 M Rose Bengal. As a result, a maximum current value was observed at −0.5 V during sweeping from positive to negative voltages, and another maximum current value was observed at 0.2 V during sweeping from negative to positive voltages. In the potential sweeping at the same speed as in Example 1, the current maximums were about a half of the corresponding current maximums in Example 1. This shows that in the thin polypyrrole film formed through chemical polymerization in the presence of iron chloride, doping with Rose Bengal anions and undoping occurred but the rates thereof were low. The thin polypyrrole film was taken out of the solution when the potential was +0.4 V, at which the film was in a completely oxidized state. As a result, this thin polypyrrole film was of a purplish red color, showing that it had been doped with Rose Bengal. It was ascertained from the above results that the thin polypyrrole film formed through chemical polymerization reversibly underwent doping with Rose Bengal anions and undoping.

EXAMPLE 11

In the same three-pole electrolytic apparatus shown in FIG. 14 as in Example 1, the potential of the working electrode 24 was maintained at +2.0 V based on the saturated calomel electrode 22 for 30 seconds in an acetonitrile solution containing 0.2 M thiophene and 0.1 M tetraethylammonium perchlorate. As a result, a thin polythiophene film was obtained on the working electrode (platinum) 24 by the electrolytic oxidation polymerization of thiophene. This thin polythiophene film was washed with acetonitrile and pure water. Using the three-pole electrolytic apparatus, the potential of the electrode covered with the washed polythiophene film was repeatedly swept in the range of from +1.0 to −0.2 V based on the saturated calomel electrode 22 in an aqueous solution containing 0.02 M Rose Bengal. As a result, a maximum current value was observed at +0.8 V during sweeping from positive to negative voltages, and another maximum current value was observed at +1.0 V during sweeping from negative to positive voltages. This shows that the thin polythiophene film formed through polymerization in acetonitrile underwent doping with Rose Bengal anions and undoping. The thin polythiophene film was taken out of the solution when the potential was +1.2 V, at which the film was in a completely oxidized state. As a result, this thin polythiophene film was of a purplish red color, showing that it had been doped with Rose Bengal. This doped film was undoped at −0.2 V in 0.1 M aqueous sodium chloride solution. As a result, the aqueous solution was colored by the released Rose Bengal.

EXAMPLE 12

A thin polythiophene film was obtained on a platinum electrode through electrolytic oxidation polymerization in an acetonitrile solution in the same manner as in Example 11. This thin polythiophene film was washed with acetonitrile and pure water. Using the three-pole electrolytic apparatus, the potential of the electrode covered with the washed polythiophene film was repeatedly swept in the range of from +0.2 to −1.5 V based on the saturated calomel electrode 22 in an aqueous solution containing 0.02 M rhodamine B. As a result, a maximum current value was observed at −1.2 V during sweeping from positive to negative voltages, and another maximum current value was observed at +1.0 V during sweeping from negative to positive voltages. This shows that the thin polythiophene film formed through polymerization in acetonitrile underwent doping with rhodamine B cations and undoping. The thin polythiophene film was taken out of the solution when the potential was −1.5 V, at which the film was in a completely reduced state. As a result, this thin polythiophene film was of a red color, showing that it had been doped with rhodamine B. This doped film was undoped at +0.2 V in 0.1 M aqueous sodium chloride solution. As a result, the aqueous solution was colored by the released rhodamine B.

EXAMPLE 13

Figure 10:
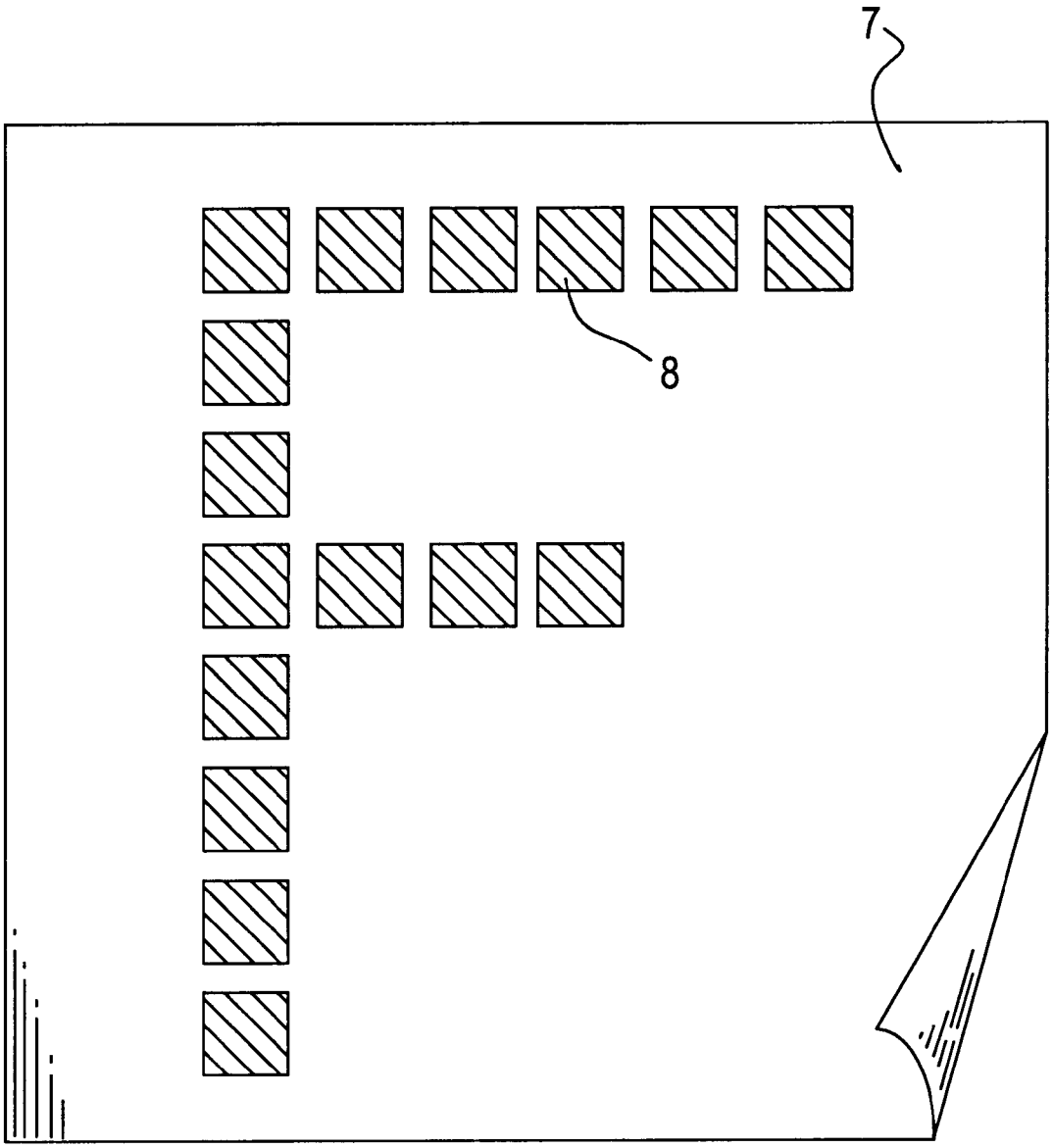
FIG. 10 is a view showing an image formed by transferring the image shown in FIG. 9.

Using a three-pole electrolytic apparatus generally employed in electrochemistry in which the working electrode was composed of matrix electrodes, the potential of the whole working electrode was maintained at +0.8 V based on the saturated calomel electrode for 30 seconds in an aqueous solution containing 0.06 M pyrrole and 0.02 M Rose Bengal. As a result, a thin polypyrrole film was obtained on the matrix electrodes by the electrolytic oxidation polymerization of pyrrole. After being washed with pure water, the polypyrrole-covered matrix electrode substrate was examined. As a result, the thin polypyrrole film formed in each matrix was of a purplish red color, showing that it had been doped with Rose Bengal. A filter paper dampened with 0.1 M aqueous sodium chloride solution was placed between the matrix electrodes and a platinum plate electrode having the same area, and a voltage of 1.5 V was applied for 10 seconds while desired electrodes among the matrix electrodes covered with the thin polypyrrole film were kept negative as shown in FIG. 9. As a result, the filter paper was colored in the same shape as the pattern where a voltage was applied, as shown in FIG. 10. It was thus ascertained that an image could be electrically transferred to a filter paper by releasing Rose Bengal anions from the thin polypyrrole film by undoping the film by means of matrix electrodes. After the release of Rose Bengal anions through undoping, the matrix electrodes which had not worked were still of the purplish red color.

EXAMPLE 14

A thin polypyrrole film was obtained on matrix electrodes by the electrolytic oxidation polymerization of pyrrole in the same manner as in Example 13. In 0.02 M aqueous Rose Bengal solution, a voltage of −1.0 V was applied once to all matrix electrodes for 10 seconds, and a voltage of +0.4 V was then applied only to the electrodes corresponding to a desired pattern to thereby incorporate Rose Bengal into those electrodes. The matrix electrodes were taken out of the solution and washed with pure water. As a result, only those parts of the washed matrix electrodes which corresponded to the pattern were of a purplish red color as shown in FIG. 11. A filter paper dampened with 0.1 M aqueous sodium chloride solution was placed between the matrix electrodes and a platinum plate electrode having the same area, and a voltage of 1.5 V was applied for 10 seconds while desired electrodes among the matrix electrodes covered with the thin polypyrrole film were kept negative. As a result, the filter paper was colored in the same shape as the pattern where the dye had been incorporated. It was thus ascertained that an image such as that shown in FIG. 12 could be transferred by doping the thin polypyrrole film with Rose Bengal anions by means of matrix electrodes. After the release of Rose Bengal anions through undoping, all the matrix electrodes had been deprived of the color.

According to the conducting polymer thin film of the present invention, a conducting polymer thin film which is capable of physicochemically, in particular electrochemically, taking up and retaining ionic dye molecules or releasing the same can be utilized.

According to the process for producing a conducting polymer thin film of the present invention, a conducting polymer thin film capable of taking up and retaining ionic dye molecules or releasing the same can be produced by polymerizing a monomer for a conducting polymer in the presence of ions having a high molecular weight, e.g., ionic dye molecules.

According to the method of working a conducting polymer thin film of the present invention, doping of a conducting polymer thin film with dye ions and undoping thereof can be conducted by changing the potential within the relatively narrow range of about ±2 V. In addition, the quantity of electricity used is small, i.e., from one to three charges are used per dye ion. Thus, the method does not necessitate a high voltage and the film can be worked with an extremely low energy.

According to the method of image formation and the apparatus for image formation of the present invention, since an image is formed by reversibly doping a conducting polymer thin film with ionic dye molecules and undoping the film by oxidizing and reducing the film, the method of image formation is energy-saving because only the ionic dye molecules are consumed, and is highly safe because the whole process is carried out in an aqueous solution. Moreover, a high image resolving power on the order of the size of a dye ion can be ideally attained in principle, and a potential distribution can be formed accurately. Therefore, the method and apparatus are excellent in image gradation, etc.

While the invention has been described in detail and with reference to specific embodiments thereof, it will be apparent to one skilled in the art that various changes and modifications can be made therein without departing from the spirit and scope thereof.

What is claimed is:

1. An apparatus for forming an image, which comprises:

a conducting polymer thin film formed on an electrode, the conducting polymer being capable of undergoing in an aqueous environment a physicochemical state change between at least two of an oxidized state, a neutral state, and a reduced state, the conducting polymer in at least one of the oxidized state, the neutral state and the reduced state retaining ionic dye molecules incorporated among the molecules of the conducting polymer, and the retained ionic dye molecules being selectively releasable from said conducting polymer to form an image;

an incorporation and release means for incorporating the ionic dye molecules into the conducting polymer thin film in the aqueous environment and for releasing the incorporated ionic dye molecules from the thin film; and a transfer means for transferring the ionic dye molecules released by the incorporation and release means to a recording medium so as to form an image.

2. The apparatus for forming an image as claimed in claim 1, wherein:

the electrode has a cylindrical or roll configuration and comprises a plurality of matrix electrodes; and the incorporation and release means includes means for incorporating the ionic dye molecules into selected electrodes among the purality of matrix electrodes and for selectively releasing the ionic dye molecules from the matrix electrodes.

3. An apparatus for forming an image, which comprises:

an aqueous source of ionic dye molecules;

a conducting polymer thin film formed on an electrode, the conducting polymer being capable of undergoing in the aqueous source a physicochemical state change between at least two of an oxidized state, a neutral state, and a reduced state, the conducting polymer in at least one of the oxidized state, the neutral state and the reduced state retaining ionic dye molecules incorporated among the molecules of the conducting polymer, and the retained ionic dye molecules being selectively releasable from the conducting polymer to form an image;

an incorporation and release device that can selectively incorporate the ionic dye molecules in the aqueous source into the conducting polymer thin film and can selectively release the incorporated dye molecules from the thin film; and a transfer device that transfers the ionic dye molecules released by the incorporation and release device to a recording medium brought into contact with the conducting polymer thin film so as to form an image.

4. The apparatus for forming an image as claimed in claim 3, wherein:

the eletrode has a cylindrical configuration and comprises a plurality of matrix electrodes; and the incorporation and release device can incorporate the ionic dye molecules into selected electrodes among the plurality of matrix electrodes and can selectivity release the ionic dye molecules from the image.

5. The apparatus for forming an image as claimed in claim 1, wherein the conducting polymer thin film is formed by polymerizing at least one monomer for the conducting polymer in the presence of ions having a high molecular weight to thereby form the conducting polymer thin film.

6. The apparatus for forming an image as claimed in claim 5, wherein the at least one monomer for the conducting polymer is electrolytically polymerized in the presence of ions having a high molecular weight to thereby form the conducting polymer thin film.

7. The apparatus for forming an image as claimed in claim 5, wherein the at least one monomer for the conducting polymer is chemically polymerized in the presence of ionic dye molecules to form the conducting polymer thin film.

* * * * *